US007822221B2

(12) United States Patent
Watanabe

(10) Patent No.: US 7,822,221 B2
(45) Date of Patent: Oct. 26, 2010

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1181 days.

(21) Appl. No.: 11/445,459

(22) Filed: Jun. 2, 2006

(65) Prior Publication Data

US 2006/0274907 A1 Dec. 7, 2006

(30) Foreign Application Priority Data

Jun. 2, 2005 (JP) ..... 2005-163087

(51) Int. Cl.
*H04R 1/02* (2006.01)
*H04R 25/00* (2006.01)
*H04R 1/00* (2006.01)

(52) U.S. Cl. ..... 381/394; 381/150; 381/395; 381/403; 381/409; 381/396

(58) Field of Classification Search ..... 381/150, 381/394, 395, 396, 403, 409
See application file for complete search history.

(56) References Cited

U.S. PATENT DOCUMENTS 2,037,811 A * 4/1936 McMurtrey et al. ..... 381/409
2,813,928 A * 11/1957 Mizrahi et al. ..... 381/62
2,906,828 A * 9/1959 Carbonneau ..... 381/409
4,068,103 A * 1/1978 King et al. ..... 381/409
4,966,558 A * 10/1990 Moriyama ..... 439/573
5,166,984 A * 11/1992 Hsiao ..... 381/397
6,088,466 A * 7/2000 Proni ..... 381/397
6,700,988 B2 * 3/2004 Wu ..... 381/404
7,263,198 B2 * 8/2007 Onuma ..... 381/403

FOREIGN PATENT DOCUMENTS

JP 6-37898 5/1994
JP 11-231876 8/1999

* cited by examiner

*Primary Examiner*—Brian Ensey
*Assistant Examiner*—Sunita Joshi
(74) *Attorney, Agent, or Firm*—Nixon & Vanderhye, PC

(57) ABSTRACT

A speaker device includes a terminal member, a voice coil bobbin, and a connecting member mounted on the voice coil bobbin. The connecting member has a terminal mounting part. A pair of claw part and hook-shaped projecting part is provided on an upper end portion of the terminal mounting part, and a mounting base having a groove is provided on a lower end portion thereof. A projecting part and an opening are provided at the upper end portion of the terminal member, and a mounting part is provided at the lower end portion thereof. The projecting part has a function to move the upper end portion of the terminal member to a circumferential direction of the connecting member.

8 Claims, 18 Drawing Sheets

<COMPARATIVE EXAMPLE>

<STEPS S1 AND S2>

<STEP S3>

<STEPS S4 TO S8>

<STEPS S9 AND S10>

SPEAKER DEVICE

BACKGROUND OF THE INVENTION

1. Field of the Invention

The present invention relates to a fixing configuration of a connecting member and a terminal member for a speaker device.

2. Description of Related Art

Conventionally, there is known an internal-magnet type speaker device including a magnetic circuit including a plane magnet, a plane plate and a pot-shaped yoke, and a vibration system including a terminal member having conductivity, a conductive damper into which a conductive member is knitted, a connecting member made of a resin material, a voice coil, a voice coil bobbin and a frame. In such a speaker device, the connecting member is mounted on the voice coil bobbin.

There is known a piezoelectric sounding body having a terminal fixing configuration with such excellent mechanical reliability that a terminal never collapses in a direction of a stress even though the stress operates on one end side of the terminal (see Japanese Utility Model Application Laid-open under No. 6-37898, for example). In addition, there is known a terminal fixing configuration of an electric part in such a form that a terminal can be stably mounted on a resin case (see Japanese Patent Application Laid-open under No. 11-231876, for example).

SUMMARY OF THE INVENTION

It is an object of this invention to provide a speaker device having a fixing configuration of a connecting member and a terminal member capable of appropriately positioning a voice coil bobbin with respect to a magnetic circuit and a vibration system.

According to one aspect of the present invention, there is provided a speaker device including: a terminal member which is electrically connected to a voice coil; and a connecting member which is mounted on a voice coil bobbin, wherein a first projecting part upwardly projecting is formed at an upper end portion of the connecting member, and a mounting base having a groove is formed at a lower end portion of the connecting member, wherein an opening into which the first projecting part is inserted is formed at an upper end portion of the terminal member, and a mounting part mounted on the mounting base in a state of being inserted into the groove is formed at a lower end portion of the terminal member, and wherein the terminal member includes a second projecting part functioning to move the upper end portion of the terminal member in a circumferential direction of the connecting member with using the mounting base as a fulcrum in such a state that the mounting part is inserted into the groove.

The above speaker device includes the terminal member electrically connecting to the voice coil and the connecting member mounted on the voice coil bobbin. The first projecting part upwardly projecting is formed at the upper end portion of the connecting member, and the mounting base having the groove is formed at the lower end portion of the connecting member. In addition, the opening into which the first projecting part is inserted is formed at the upper end portion of the terminal member, and the mounting part mounted on the mounting base of the connecting member in such a state of being inserted into the groove of the connecting member is formed at the lower end portion of the terminal member.

Particularly, in this speaker device, the terminal member includes the second projecting part having the function to move the upper end portion of the terminal member in the circumferential direction of the connecting member with using the mounting base of the connecting member as the fulcrum in such a state that the mounting part is inserted into the groove of the connecting member. Therefore, in the manufacturing process of the speaker device, the mounting part of the terminal member is inserted into the groove of the connecting member, and the second projecting part of the terminal member is moved in the circumferential direction of the connecting member with using the mounting base of the connecting member as the fulcrum. Thereby, the first projecting part of the connecting member can be inserted into the opening of the terminal member. In a preferred example, the second projecting part may be provided on one end side of the upper end portion of the terminal member.

According to the mounting method, since an external force of moving the voice coil bobbin on the side of the magnetic circuit does not operate at the time of mounting the terminal member on the connecting member, it can be prevented that each component such as the voice coil bobbin is mounted on a position shifted with respect to the appropriate position of the magnetic circuit and the vibration system. Namely, each of the components including the voice coil bobbin can be securely mounted on the appropriate position of the magnetic circuit and the vibration system. Thus, at the time of driving of the speaker device, the vibration system including the voice coil bobbin can appropriately operate. As a result, there occurs no difference insensitivity (sound pressure level), and deterioration of sound quality can be securely prevented.

In a preferred example, the first projecting part may have a claw part having a substantially triangle cross-sectional shape and a hook-shaped projecting part provided at a position adjacent to the claw part and having a hook shape, and the claw part and the hook-shaped projecting part in a state of being inserted into the opening may fix the upper end portion of the terminal member to the upper end portion of the connecting member.

In a manner of the above speaker device, a third projecting part arranged at a position overlapping none of the first projecting part and upwardly projecting may be formed at the upper end portion of the connecting member, and when an upper end surface of the connecting member is prescribed as a reference surface, a distance from the reference surface to an upper end surface of the third projecting part may be relatively larger than a distance from the reference surface to an upper end surface of the first projecting part.

In this manner, the third projecting part arranged at the position overlapping none of the first projecting part of the connecting member and upwardly projecting is formed at the upper end portion of the connecting member. When the upper end surface of the connecting member is prescribed as the reference surface, the distance from the reference surface to the upper end surface of the third projecting part relatively becomes larger than the distance from the reference surface to the upper end surface of the first projecting part. Therefore, the upper end surface of the third projecting part is upwardly positioned with respect to the upper end surface of the first projecting part. In a preferred example, the distance from the reference surface to the upper end surface of the third projecting part may be set to substantially 1.3 mm, and the distance from the reference surface to the upper end surface of the first projecting part may be set to substantially 1.1 mm.

The connecting member being a completed product is housed into a packing box such as a corrugated fiber board box in the manufacturing process of the speaker device, and it is transported to a place in which an operation in the next process is executed. The packing box includes partition boards of plural floors therein. The connecting members of the predetermined number are mounted on the respective partition boards to be transported.

Hence, even if an impact of some kind is added to the packing box at the time of housing the connecting member being the completed product into the pacing box or at the time of transporting the packing box housing the plural connecting members, a part of the connecting member colliding with the partition board is the third projecting part, and the partition board and the first projecting part never collide with each other. Namely, the third projecting part has a function to prevent the collision between the first projecting part and the partition board. Thereby, in such a state that a large number of connecting members are housed into the packing box, they can be transported without any damage of the first projecting part of each connecting member. As a result, transportation efficiency of the connecting members can be improved.

According to another aspect of the present invention, there is provided a manufacturing method of a speaker device including: a process which mounts a connecting member on an outer peripheral wall of a voice coil bobbin and arranges the voice coil bobbin integrated with the connecting member at a predetermined position of a magnetic circuit; and a process which moves a second projecting part provided at an upper end portion of a terminal member in a circumferential direction of the connecting member with using a mounting part as a fulcrum in such a state that a mounting base provided at a lower end portion of the terminal member is inserted into a groove of the mounting base provided at a lower end portion of the connecting member, and inserts a first projecting part provided at the upper end portion of the connecting member into an opening provided at the upper end portion of the terminal member to mount the terminal member on the connecting member.

According to the manufacturing method of the above speaker device, in the first process, the connecting member is mounted on the outer peripheral wall of the voice coil bobbin, and the voice coil bobbin integrated with the connecting member is arranged at a predetermined position of the magnetic circuit. The mounting of the connecting member on the appropriate position of the outer peripheral wall of the voice coil bobbin can be executed by using a jig. In the next process, the mounting part provided at the lower end portion of the terminal member is inserted into the groove of the mounting base provided at the lower end portion of the connecting member, and the second projecting part provided at the upper end portion of the terminal member is moved to the circumferential direction of the connecting member with using the mounting base as the fulcrum. Then, the first projecting part provided at the upper end portion of the connecting member is inserted into the opening provided at the upper end portion of the terminal member, and the terminal member is mounted on the connecting member. According to the mounting method, when the terminal member is mounted on the connecting member, there does not operate the external power of moving the voice coil bobbin integrated with to the connecting member to the side of the magnetic circuit. Thus, the voice coil bobbin can be mounted on the appropriate position of the vibration system and the magnetic circuit. Therefore, the speaker device manufactured by the manufacturing method can appropriately operate the vibration system including the voice coil bobbin at the time of driving thereof. As a result, there occurs no difference of the sensitivity (sound pressure level), and the deterioration of the sound quality can be securely prevented.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

[Configuration of Speaker Device]

First, a description will be given of a configuration of a speaker device 100 according to an embodiment of the present invention with reference to FIGS. 1A and 1B to FIG. 3.

Figure 1B:
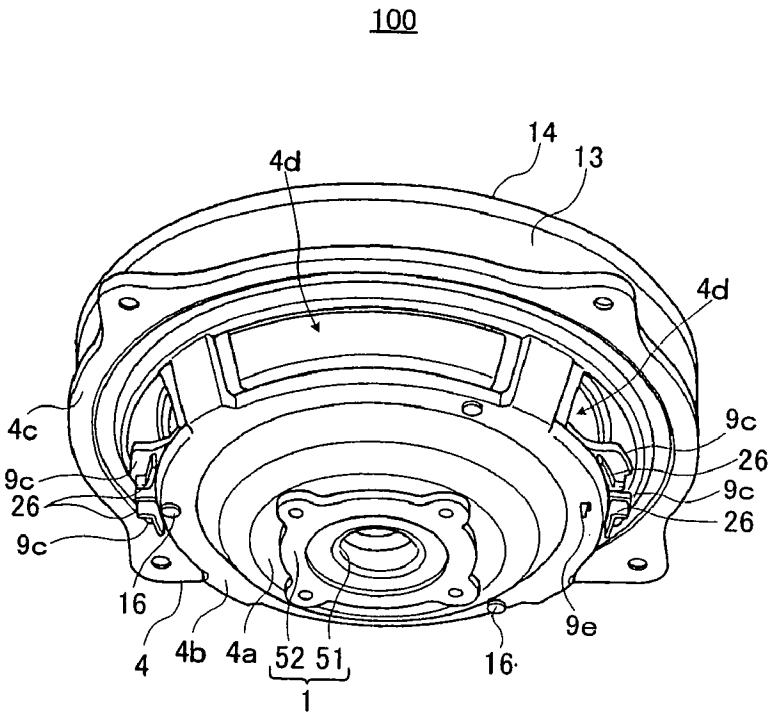
FIGS. 1A and 1B show perspective views of a speaker device according to an embodiment of the present invention when observed from a front side and a rear side thereof.
Figure 1A:
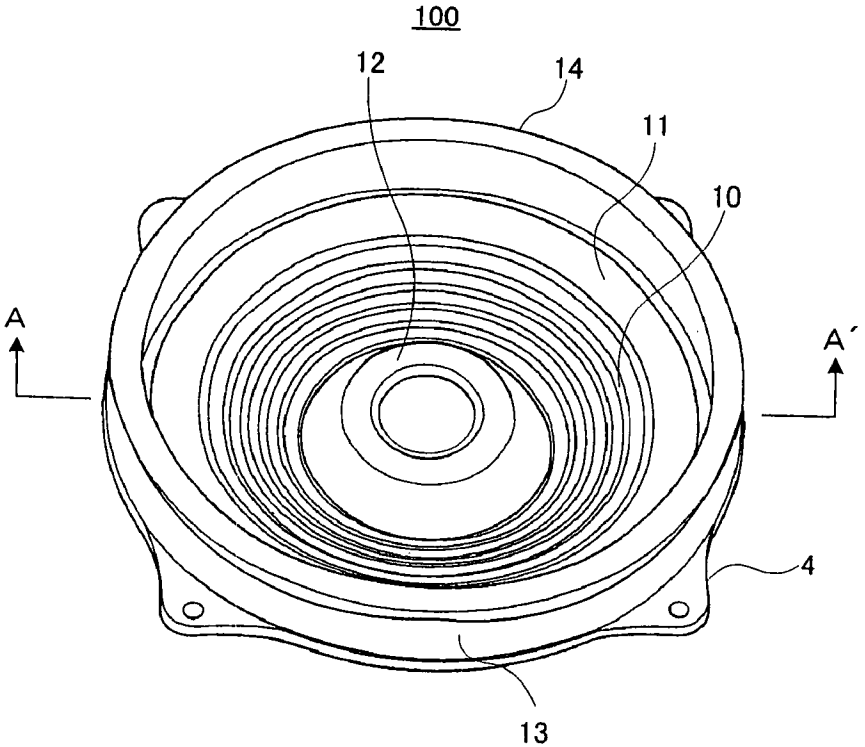
Figure 2:
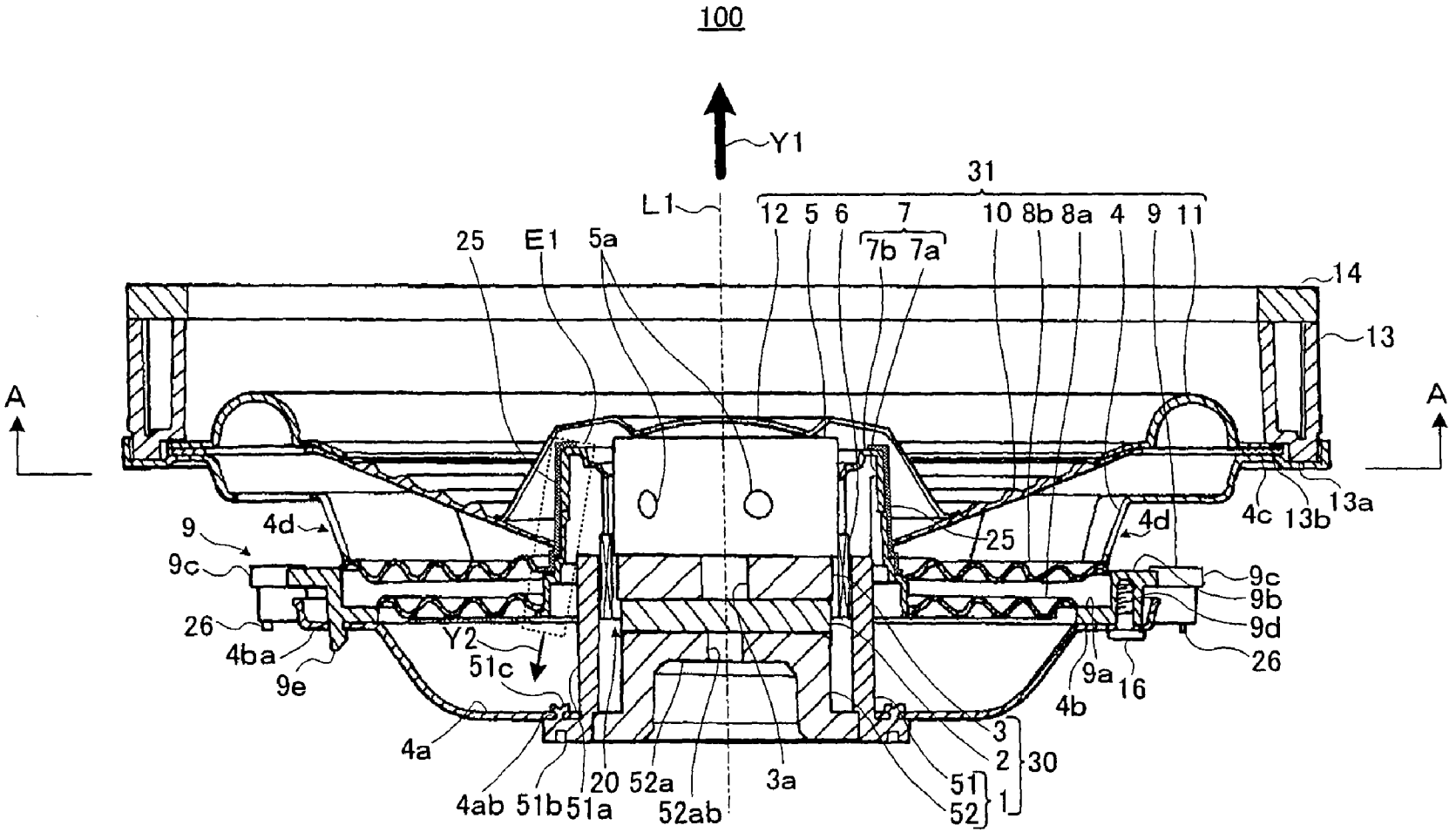
FIG. 2 shows a cross-sectional view of the speaker device along a cutting line A-A' shown in FIG. 1A.
Figure 3:
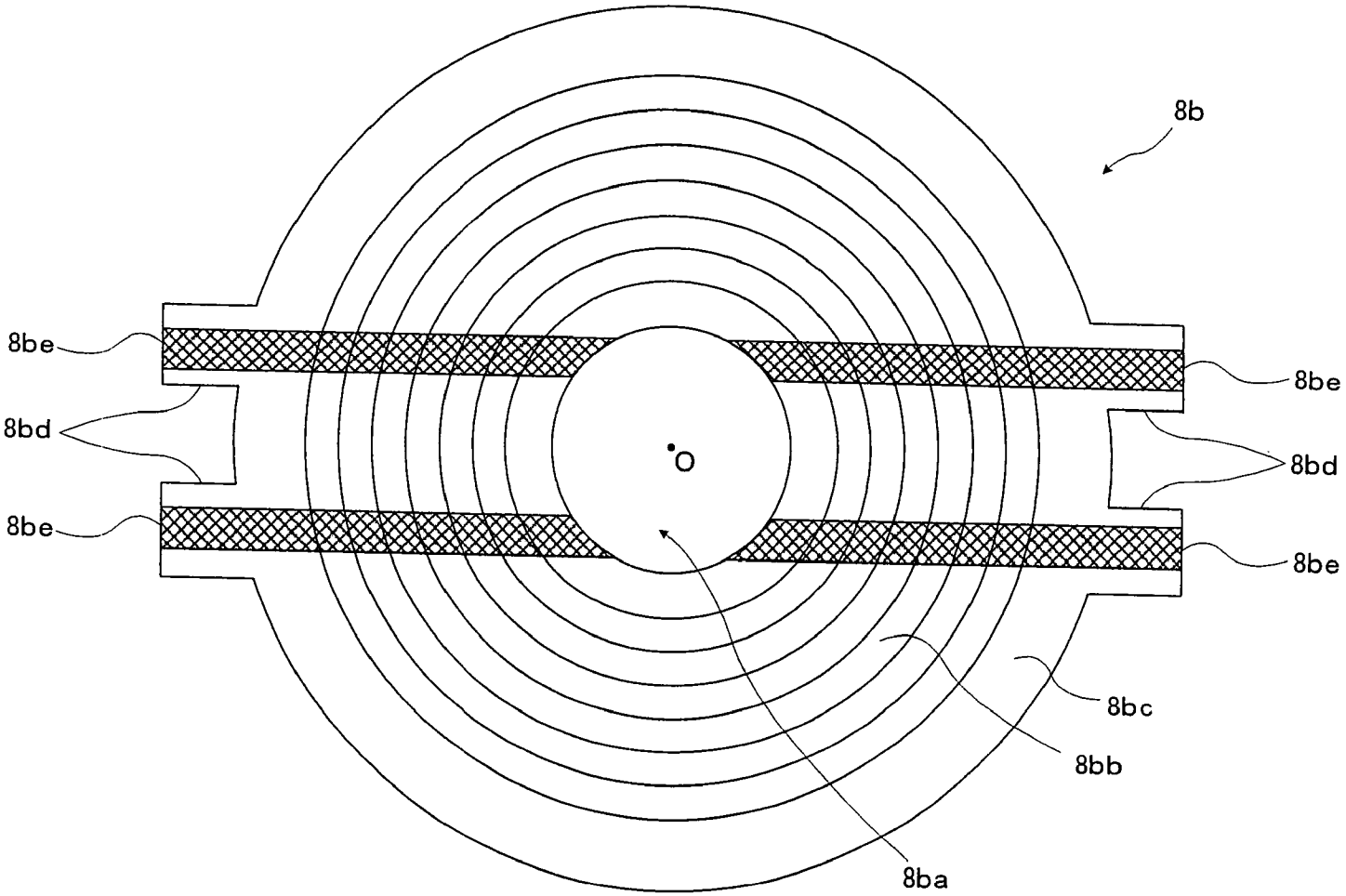
FIG. 3 is a plan view showing a configuration of a conductive damper.

FIG. 1A shows a perspective view of the speaker device 100 according to the embodiment of the present invention when observed from a sound output side. Meanwhile, FIG. 1B shows a perspective view of the speaker device 100 according to the embodiment when observed from a direction opposite to the sound output side. FIG. 2 shows a cross-sectional view of the speaker device 100 according to the embodiment when cut along a plane including a central axis L1. FIG. 3 is a plan view showing a configuration of a conductive damper 8*b*.

The speaker device 100 mainly includes a magnetic circuit 30 including a yoke 1, a magnet 2 and a plate 3, a vibration system 31 including a frame 4, a voice coil bobbin 5, a voice coil 6, a connecting member 7, a damper 8*a*, a conductive damper 8*b*, a supporting member 9, a diaphragm 10, an edge 11 and a cap 12, and plural members including a packing 13 and a buffer member 14. The speaker device 100 is preferably used for a vehicle speaker device.

First, a description will be given of each component of the magnetic circuit 30. The magnetic circuit 30 is configured as an internal-magnet type magnetic circuit.

The yoke 1 has a main body part 51 and a bottom part 52, which are bonded.

The main body part 51 has a cylindrical part 51*a* formed into a cylindrical shape and a flange part 51*b* outwardly extending from a lower end portion of an outer peripheral wall of the cylindrical part 51*a*. Plural projecting parts 51*c* are formed on the flange part 51*b* with appropriate spaces in the circumferential direction. Each of the projecting parts 51*c* has a function to fix the yoke 1 to the frame 4, which will be described later.

The bottom part 52 is formed into a cross-sectional shape obtained by turning a substantially recessed shape upside down. On an upper end portion of the bottom part 52, a mounting part 52*a* formed into a circle plane shape and having flatness is formed. On the mounting part 52*a*, the magnet 2 is arranged. At a center of the mounting part 52*a*, an opening 52*ab* is formed.

The magnet 2 formed into a flat-plate shape is mounted on the mounting part 52*a* of the yoke 1. The plate 3 formed into an annular shape is mounted on the magnet 2. At a center of the plate 3, an opening 3*a* is formed. A magnetic gap 20 is formed between an outer peripheral wall of the plate 3 and an inner peripheral wall of the main body part 51. The magnetic flux of the magnet 2 is concentrated on the magnetic gap 20.

Next, a description will be given of each component of the vibration system 31.

Various kinds of components configuring the speaker device 100 are mounted on the frame 4. The frame 4 functions to support each of the components. The frame 4 can be made of various kinds of known materials. When a heat radiation rate of the speaker device 100 is to be improved, the frame 4 is preferably made of a metallic material having the good thermal conductivity. In this case, the frame 4 functions as a medium transmitting and receiving the heat between an internal space of the speaker device 100 and an external space thereof. The frame 4 formed into a substantial cup shape mainly includes a first flange part 4*a* formed at a lower end portion thereof, a second flange part 4*b* formed at a substantially middle portion thereof, a third flange part 4*c* formed at an upper end portion thereof, and plural openings 4*d* formed between the second flange part 4*b* and the third flange part 4*c*.

The first flange part 4*a* is mounted on the above-mentioned flange part 51*b* being the component of the yoke 1. Now, a mounting method thereof will be briefly explained. On the first flange part 4*a* of the frame 4, the plural openings 4*ab* are provided with appropriate spaces in the circumferential direction. In addition, each of the openings 4*ab* is provided at a position corresponding to each of the projecting parts 51*c* of the yoke 1. Therefore, when the frame 4 is mounted on the yoke 1, first, each of the projecting parts 51*c* is inserted into each of the openings 4*ab*, and the first flange part 4*a* of the frame 4 is mounted on the flange part 51*b* of the yoke 1. Next, the upper end portion of each of the projecting parts 5*c* is caulked by a caulking jig. Thereby, the first flange part 4*a* of the frame 4, which is sandwiched between the upper end portion of each of the deformed projecting parts 51*c* and the flange part 51*b*, is fixed.

The supporting member 9, which will be described later, is mounted on the second flange part 4*b*. An opening 4*b* a is provided at an appropriate position of the second flange part 4*b*. The opening 4*b a* is engaged with a claw part 9*e* of the supporting member 9 which will be explained later. An outer peripheral edge portion of the edge 11 and the packing 13, which will be described later, are mounted on the third flange part 4*c*, respectively. Each of the openings 4*d* is provided with appropriate spaces in the circumferential direction of the frame 4. Each of the openings 4*d* has a function to radiate the heat generated in the magnetic circuit 30 to the external space of the speaker device 100.

The voice coil bobbin 5 is formed into a cylindrical shape. At the substantially middle position on the side wall of the voice coil bobbin 5, plural ventilation holes 5*a* are provided with appropriate spaces in the circumferential direction thereof. The voice coil 6 is wound around the vicinity of the lower end portion of the outer peripheral wall of the voice coil bobbin 5. The vicinity of the lower end portion of the inner peripheral wall of the voice coil bobbin 5 is opposite to the outer peripheral walls of the magnet 2 and the plate 3 with constant spaces. Meanwhile, the vicinity of the lower end portion of the outer peripheral wall of the voice coil bobbin 5 is opposite to the upper end portion of the inner peripheral wall of the cylindrical part 51 being the component of the yoke 1 with a constant space.

Figure 5:
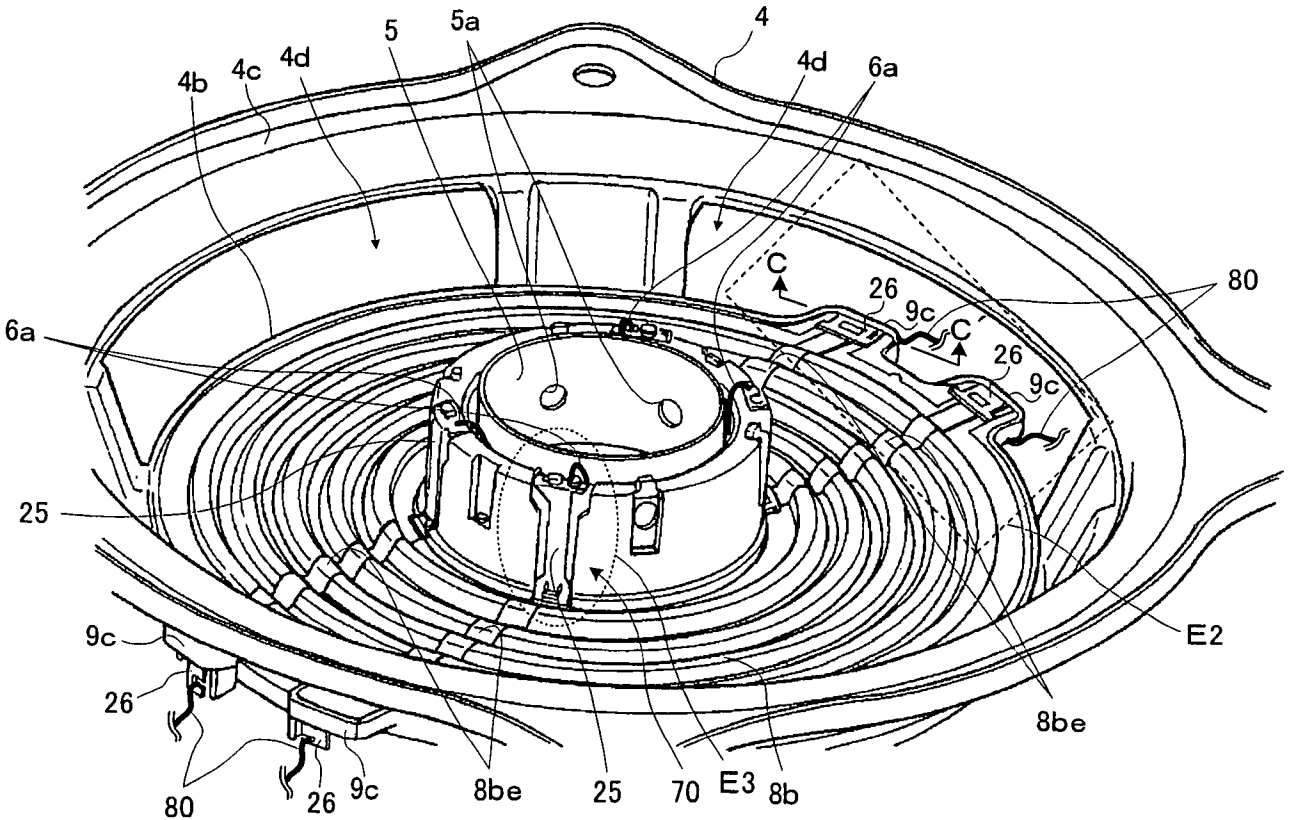
FIG. 5 is a partly perspective view showing such a state that the terminal member is mounted on a terminal mounting part of a connecting member.

The voice coil 6 has two lead wires 6*a* including plus lead wires and minus lead wires (see FIG. 5). Each of the plus lead wires 6*a* is an input wiring for an L(or R)-channel signal, and each of the minus lead wires is an input wiring for a ground (GND:ground) signal.

Figure 6:
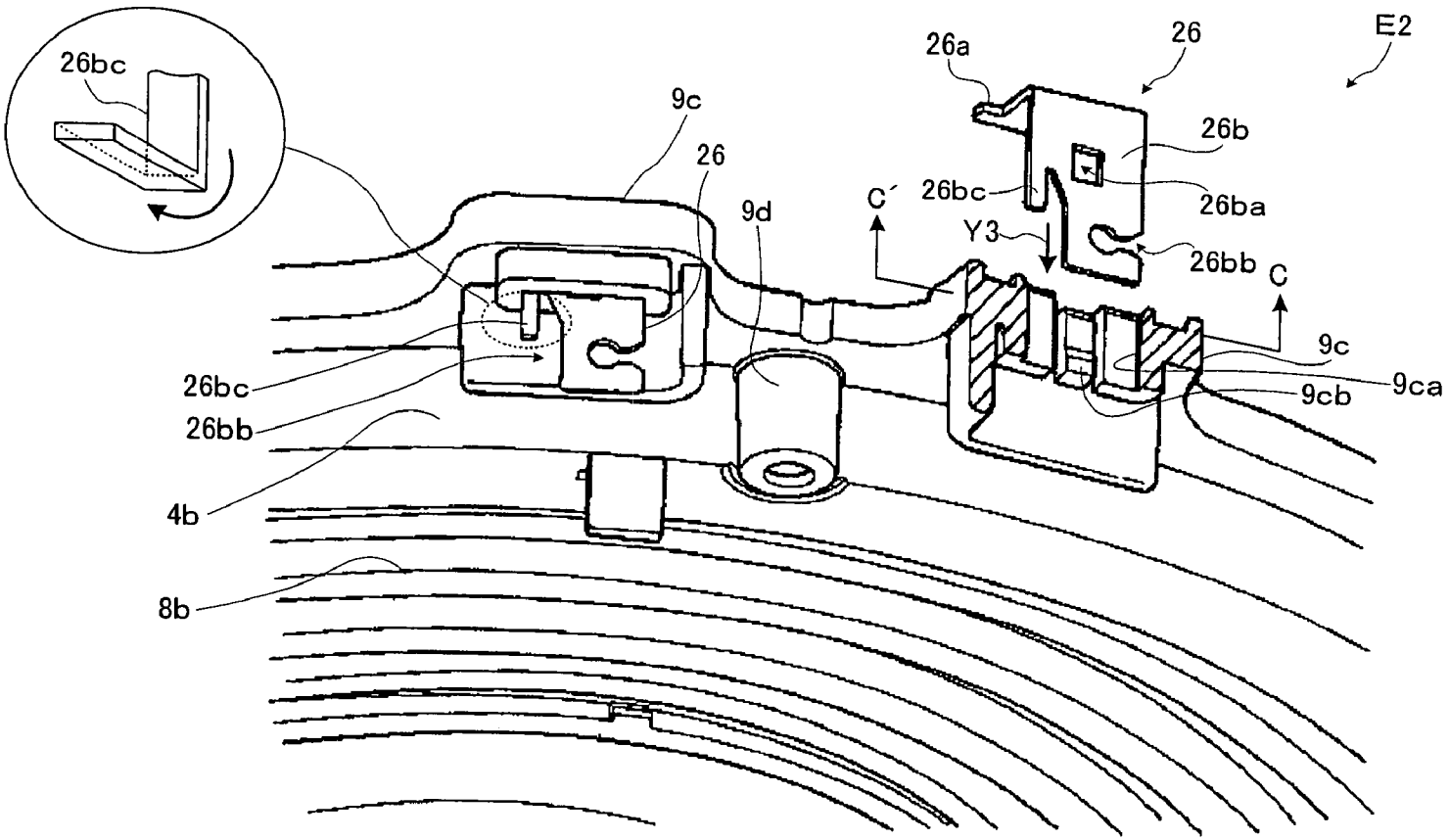
FIG. 6 is a partly-enlarged perspective view showing such a state that the terminal member is mounted on the terminal mounting part of a supporting member.

The supporting member (spacer) 9 has a function to support each of the outer peripheral edge portions of the damper 8*a* and the conductive damper 8*b*. The supporting member 9 is preferably made of a resin material in order to lighten the speaker device 100, for example. The supporting member 9, formed into a substantially annular plane shape and a step-formed cross-sectional shape, has a first flat part 9*a*, a second flat part 9*b* provided at an upper portion of the first flat part 9*a* and on the outer side thereof, and plural hook-shaped claw parts 9*e* provided on the lower surface side of the one end side of the first flat part 9*a*. The outer peripheral edge portion of the damper 8*a* is mounted on the first flat part 9*a*, and the outer peripheral edge portion of the conductive damper 8*b* is mounted on the second flat part 9*b*. In addition, plural terminal mounting parts 9*c* on which plural terminal members 26 are mounted are provided on the second flat part 9*b*. As shown in FIG. 6, the terminal mounting parts 9*c* include spaces 9*ca* into which the terminal members 26 (which will be described later) are inserted, and hook-shaped claw parts 9*cb* for fixing the terminal member 26 to the terminal mounting part 9*c*. At a portion from the lower surface side of the first flat part 9*a* to the second flat part 9*b*, there is provided a screw hole 9*d* for fixing the supporting member 9 onto the second flange part 4*b* of the frame 4 by a bolt 16. Each of the claw parts 9*e* is engaged with each of the openings 4*ba* provided at the second flange part 4*b* of the frame 4 to fix the supporting member 9 to the second flange part 4*b*.

The connecting member (cup) 7 characterized by the present invention has a function to support each of the inner peripheral edge portions of the diaphragm 10, the damper 8*a* and the conductive damper 8*b*. In addition, at appropriate positions of the connecting member 7, plural terminal members 25 are provided. Similarly to the supporting member 9, the connecting member 7 is preferably made of the resin material in order to lighten the speaker device 100, for example. The connecting member 7 basically includes a cylindrical part 7*a* formed into a substantially cylindrical shape, and a curved part 7*b* provided to be curved from the upper end portion of the cylindrical part 7*a* to the inner side thereof, i.e., to the side of the central axis L1. The cylindrical part 7*a* and the curved part 7*b* are integrated with each other. The inner peripheral edge portion of the connecting member 7, i.e., the inner peripheral edge portion of the curved part 7*b*, is mounted on the vicinity of the upper end portion of the outer peripheral wall of the voice coil bobbin 5. The detailed configuration of the connecting member 7 will be explained later.

The damper 8*a* formed into a substantially annular shape has an elastic part on which corrugations are concentrically formed, and it elastically supports the connecting member 7 and the voice coil bobbin 5. The inner peripheral edge portion of the damper 8*a* is mounted on a first flange part 7*ab* (see FIG. 7A) provided in the vicinity of the lower end portion of the outer peripheral wall of the connecting member 7. Meanwhile, the outer peripheral edge portion of the damper 8*a* is mounted on the first flat part 9*a* being the component of the supporting member 9.

The conductive damper 8*b* has a function to elastically support the connecting member 7 and the voice coil bobbin 5 with the damper 8*a*. The conductive damper 8*b*, which is formed slightly larger than the damper 8*a*, has the substantially same shape as that of the damper 8*a*. However, the conductive damper 8*b* has plural conductive parts 8*be*. The inner peripheral edge portion of the conductive damper 8*b* is mounted on the upper side of the damper 8*a* and on a second flange part 7*ac* (see FIG. 7A) provided in the vicinity of the lower end portion of the outer peripheral wall of the connecting member 7. Meanwhile, the outer peripheral edge portion of the conductive damper 8*b* is mounted on the second flat part 9*b* being the component of the supporting member 9.

Concretely, as shown in FIG. 3, the conductive damper 8*b* has an opening 8*ba*, an elastic part 8*bb*, a mounting base 8*bc*, plural projecting parts 8*bd* and plural conductive parts 8*be*.

The opening 8*ba* is formed at the center of the conductive damper 8*b*. The opening 8*ba* is an insertion hole used when the conductive damper 8*b* is mounted on the outer peripheral wall of the connecting member 7. The elastic part 8*bb* is formed into the same corrugation as the elastic part of the damper 8*a*, and it has a function to elastically support the connecting member 7. The inner peripheral edge portion of the elastic part 8*bb* is mounted on the upper portion of the damper 8*a* and on the second flange part 7*ac* (see FIG. 7A) provided in the vicinity of the lower end portion of the outer peripheral wall of the connecting member 7. The mounting base 8*bc* has flatness and outwardly extends from the outer peripheral edge portion of the elastic part 8*bb*. The mounting base 8*bc* is mounted on the second flat part 9*b* of the supporting member 9. Each of the projecting parts 8*bd* outwardly extends from an appropriate position of the outer peripheral edge portion of the mounting base 8*bc*. As shown in FIG. 3, in this embodiment, the four projecting parts 8*bd* are provided. Each of the projecting parts 8*bd* is provided at the position corresponding to each of the terminal mounting parts 9*c* provided on the second flat part 9*b* of the supporting member 9, and each of them is mounted on each of the terminal mounting parts 9*c* (see FIG. 5). The plural conductive parts 8*be* are made of a conductive material. Each of the conductive parts 8*be* is woven into a plane-knit state to outwardly extend into a stripe state on the upper surface side of the conductive damper 8*b* and from the inner peripheral edge portion of the elastic part 8*bb* to each of the projecting parts 8*bd*.

The plural members include the plural terminal members 25 and 26 other than the packing 13 and the buffer member 14, which will be described later.

Figure 4B:
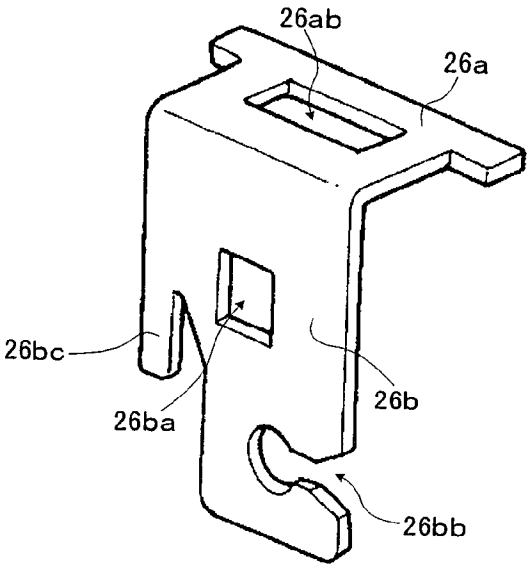
FIGS. 4A and 4B are perspective views showing configurations of respective terminal members.
Figure 4A:
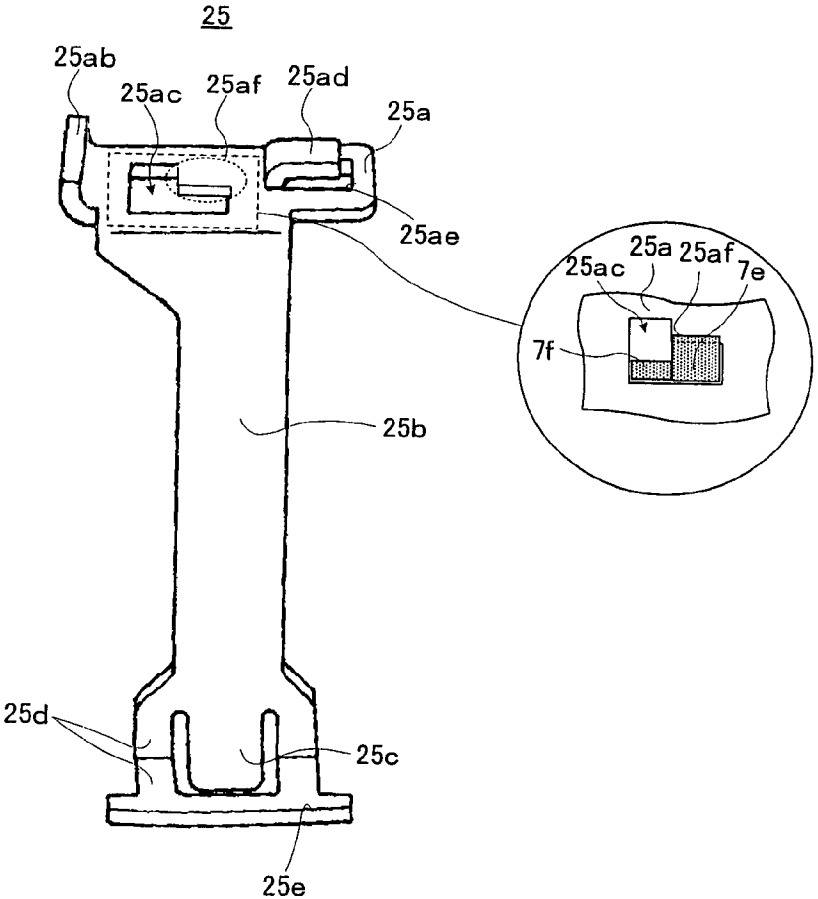

FIG. 4A is a perspective view showing a configuration of the terminal member 25. Meanwhile, FIG. 4B is a perspective view showing a configuration of the terminal member 26. FIG. 5 is a perspective view showing such a state that each of the terminal members 25 is mounted on a terminal mounting part 70 provided on the outer peripheral wall of the connecting member 7 and such a state that each of the terminal members 26 is mounted on each of the terminal mounting parts 9*c*. In addition, FIG. 5 is a perspective view showing such a state that each of the terminal members 25 and 26 are electrically connected to each of the conductive parts 8*be* of the conductive damper 8*b*. FIG. 5 shows only the minimum components necessary for explanation.

The plural terminal members 25 formed into a shape shown in FIG. 4A are made of a member having the conductive property. Since the configuration of the terminal member 25 will be explained in detail later, now the explanation thereof is omitted. Each of the terminal members 25 is mounted on each of the terminal mounting parts 70 provided on the outer peripheral wall of the connecting member 7. The lower end portion of each of the terminal members 25 is electrically connected to one end side of each of the conductive parts 8*be* of the conductive damper 8*b*, and the upper end portion of each of the terminal members 25 is electrically connected to each of the plus lead wires 6*a* and each of the minus lead wires 6*a* drawn from the voice coil 6.

On the other hand, the plural terminal members 26 are made of the member having the conductive property, similarly to the above-mentioned plural terminal members 25. Each of the terminal members 26 has a top board part 26*a* having an opening 26*ab* and a standing part 26*b* curved in a substantially right angle from one end side of the top board part 26*a*. The standing part 26*b* has an opening 26*ba* provided at a substantially middle portion thereof, a connecting part 26*bb* having a hook hole-shaped cut-out part provided on the one end side, and a fixing part 26*bc* provided on the one end side and at a position adjacent to the connecting part 26*bb*. One end side of each of plus and minus output wirings 80 of the amplifier is wound around the connecting part 26*bb*. The fixing part 26*bc* has a function to fix the terminal member 26 being the main body to the supporting member 9.

Now, a description will be briefly given of a method of mounting the terminal member 26 to the terminal mounting part 9*c* of the supporting member 9, with reference to FIG. 6. FIG. 6 is a partly-enlarged perspective view of the vicinity of a broken-line area E2 shown in FIG. 5 when observed from a rear side thereof, and it is also a perspective view explaining the method of mounting each of the terminal members 26 to each of the terminal mounting parts 9*c* of the supporting member 9. In addition, FIG. 6 shows the one of the plural terminal mounting parts 9*c* as a cross-sectional view along a cut-line C-C' shown in FIG. 5B for convenience of explanation. FIG. 6 shows only the minimum components necessary for the explanation.

First, the connecting part 26*bb* and the fixing part 26*bc* are inserted into the space 9*c* a of the terminal mounting part 9*c* in the direction of an arrow Y3 until the lower surface side of the top board part 26*a* contacts the conductive part 8*be* of the conductive damper 8*b*. Further, from the position, the connecting part 26*bb* and the fixing part 26*bc* are inserted into the lower side, i.e., in the direction of the arrow Y3. Thereby, the claw part 9*cb* of the terminal mounting part 9*c* is engaged with the opening 26*ba* of the terminal member 26, and the terminal member 26 is fixed to the terminal mounting part 9*c*. Subsequently, the fixing part 26*bc* sticking out of the space 9*c* a is curved into the outer side of the supporting member 9 in the substantially right angle, as shown by an arrow of an enlarged illustration in FIG. 6. Thereby, the terminal member 26 is fixed to the terminal mounting part 9*c* of the supporting member 9. Next, soldering is performed on the top board part 26*a* including the opening 26*ab*. Meanwhile, the one end side of each of the plus and minus output wirings 80 of the amplifier is wound around the connecting part 26*bb*, and the soldering is performed thereon (not shown). Thereby, each of the terminal members 26 is electrically connected to the other end side of each of the conductive parts 8*be* of the conductive damper 8*b* and each of the output wirings 80 of the amplifier.

FIG. 5 shows such a state that each of the lead wires 6*a* including the plus lead wires and the minus lead wires of the voice coil 6, each of the terminal members 25, each of the conductive parts 8*be*, each of the terminal members 26 and each of the plus and minus output wirings 80 of the amplifier are electrically connected to each other. Thereby, the signal and power for 2-channels are supplied to the voice coil 6 from each of the output wirings 80 of the amplifier via each of the terminal members 26, each of the conductive parts 8*be* and each of the terminal members 25. A detailed description will be given of a fixing configuration between each of the terminal members 25 and the connecting member 7, later.

The diaphragm 10 formed into a cone shape has a function to output an acoustic wave. The material of the diaphragm 10 may be selected from paper, polymeric and metallic materials and other various materials according to one of various kinds of use. The inner peripheral edge portion of the diaphragm 10 is mounted on a third flange part 7*ad* (see FIG. 7A) provided on the upper portion of the conductive damper 8*b* and in the vicinity of the substantially middle portion of the outer peripheral wall of the connecting member 7. The inner peripheral edge portion of the edge 11 having an Q-shaped cross-sectional shape and an annular plan shape is mounted on the outer peripheral edge portion of the diaphragm 10. The outer peripheral edge portion of the edge 11 is mounted on the third flange part 4*c* of the frame 4. The edge 11 has a function to suppress unnecessary vibration occurring at the time of the driving of the speaker device 100.

The cap 12 formed into a cup shape is mounted on a position in the vicinity of the inner peripheral portion of the upper surface side of the diaphragm 10 to cover the voice coil bobbin 5 and the connecting member 7. Therefore, the cap 12 mainly has a function to prevent a foreign material such as dust from entering the inside of the speaker device 100. In addition, the material of the cap 12 may be selected from paper, polymeric and metallic materials and other various materials.

The packing 13 having a substantially U-shaped cross-sectional shape and an annular plan shape is made of a material having insulating property such as a resin. In addition, a first flat surface 13*a* having the flatness, and a second flat surface 13*b* provided on the upper portion of the first flat surface 13*a* and on the inner side thereof and having the flatness are provided on the lower surface side of the packing 13. The lower surface side of the packing 13 is formed into a step shape when cross-sectionally observed. The packing 13 is mounted on the outer peripheral edge portion of the edge 11 and the third flange part 4*c* in such a state that the first flat surface 13*a* and the third flange part 4*c* of the frame 4 contact and the second flat surface 13*b* and the outer peripheral edge portion of the edge 11 contact. Therefore, the outer peripheral edge portion of the edge 11, which is sandwiched by the second flat surface 13*b* of the packing 13 and the third flange part 4*c* of the frame 4, is fixed onto the third flange part 4*c*.

The buffer member 14 is made of a stick-type member having a cushion property such as urethane and sponge. An adhesive is applied to the lower surface of the buffer member 14, or a double face tape is attached to it. The buffer member 14 deformed into an annular shape is mounted on the packing 13 via the adhesive or the double face tape. The speaker device 100 according to this embodiment is mounted on the mounting base via the buffer member 14. Thus, the buffer member 14 mainly has a function to suppress the transmission of the unnecessary vibration, which occurs in the speaker device 100 at the time of the driving of the speaker device 100, to the mounting base.

In the speaker device 100 having the above-mentioned configuration, the signal and power outputted from each of the output wirings 80 of the amplifier is supplied to the voice coil 6 via each of the terminal members 26, each of the conductive parts 8*be* of the conductive damper 8*b*, each of the terminal members 25 and each of the lead wirings 6*a* of the voice coil 6. Thereby, the driving power is generated to the voice coil 6 in the magnetic gap 20, and the diaphragm 10 is vibrated in the direction of the central axis L1 of the speaker device 100. In this manner, the speaker device 100 outputs the acoustic wave from the front side of the diaphragm 10, i.e., in the direction of the arrow Y1.

[Fixing Configuration of Terminal Member and Connecting Member]

Next, a detailed description will be given of a fixing configuration of the terminal member 25 and the connecting member 7 characterized by the present invention, with reference to FIGS. 4A and 4B to FIGS. 7A and 7B. First, the configuration of the terminal member 25 will be explained in detail, and next the configuration of the connectingmember 7 will be explained in detail. Subsequently, the fixing configuration of the terminal member 25 and the connecting member 7 will be explained in detail.

(Configuration of Terminal Member)

First, a detail description will be given of the configuration of the terminal member 25 with reference to FIG. 4A.

The terminal member 25 has a top board part 25*a*, a standing part 25*b*, a mounting part 25*c*, a curved part 25*d* and a connecting part 25*e*.

The top board part 25*a* is provided at the upper end portion of the terminal member 25. The top board part 25*a* has a projecting part 25*ab* upwardly projecting from one end side thereof, an opening 25*ac* provided in the vicinity of the projecting part 25*ab*, a projecting part 25*af* provided in the vicinity of the opening 25*ac*, a hook part 25*ad* and a slit 25*ae*. The projecting part 25*ab* is used when the terminal member 25 is mounted on the connecting member 7. The opening 25*ac* has a step-shaped plane shape. The opening 25*ac* is engaged with a pair of hook-shaped projecting part 7*e* and claw part 7*f* being component of the connecting member 7 shown in FIGS. 7A and 7B. The enlarged illustration shown in FIG. 4A shows a relative positional relation of the opening 25*ac* and the pair of hook-shaped projecting part 7*e* and claw part 7*f*, when it is assumed that the opening 25*ac* is engaged with the pair of hook-shaped projecting part 7*e* and claw part 7*f* being the component of the connecting member 7 shown in FIG. 7A. The point end portion of each of the lead wirings 6*a* of the voice coil 6 is wound around the hook part 25*ad*, and the soldering is applied to the vicinity of the hook part 25*ad* and the slit 25*ae*.

The standing part 25*b* is downwardly curved from the one end side of the top board part 25*a* in the substantially right angle. The mounting part 25*c* is formed to downwardly extend from the substantially center position of the one end side of the standing part 25*b*. Each of the curved parts 25*d* is provided at a position corresponding to both sides of the mounting part 25*c*. Each of the curved parts 25*d* outwardly extends from the one end side of the standing part 25*b*, and further each of them is outwardly curved from the position in the substantially right angle. Namely, each of them is curved in the direction away from the standing part 25*b* in the substantially right angle. The connecting part 25*e* extending from one end side of each of the curved parts 25*d* is formed into a plane shape. The connecting part 25*e* is electrically connected to each of the conductive parts 8*be* of the conductive damper 8*b*.

(Configuration of Connecting Member)

Next, the configuration of the connecting member 7 will be explained in detail with reference to FIGS. 7A and 7B.

Figure 7B:
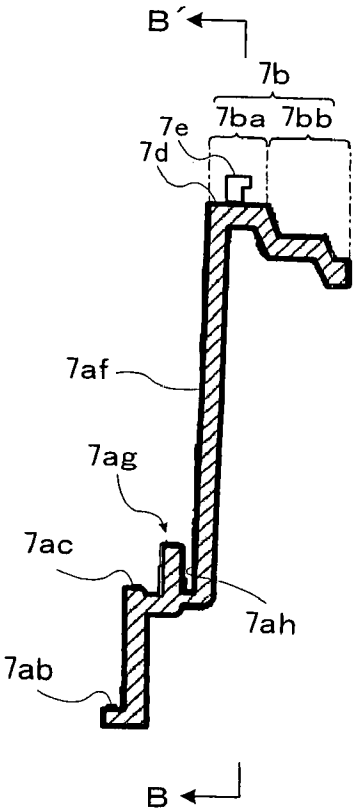
FIGS. 7A and 7B show a perspective view and a cross-sectional view showing the configuration of the connecting member, respectively.
Figure 7A:
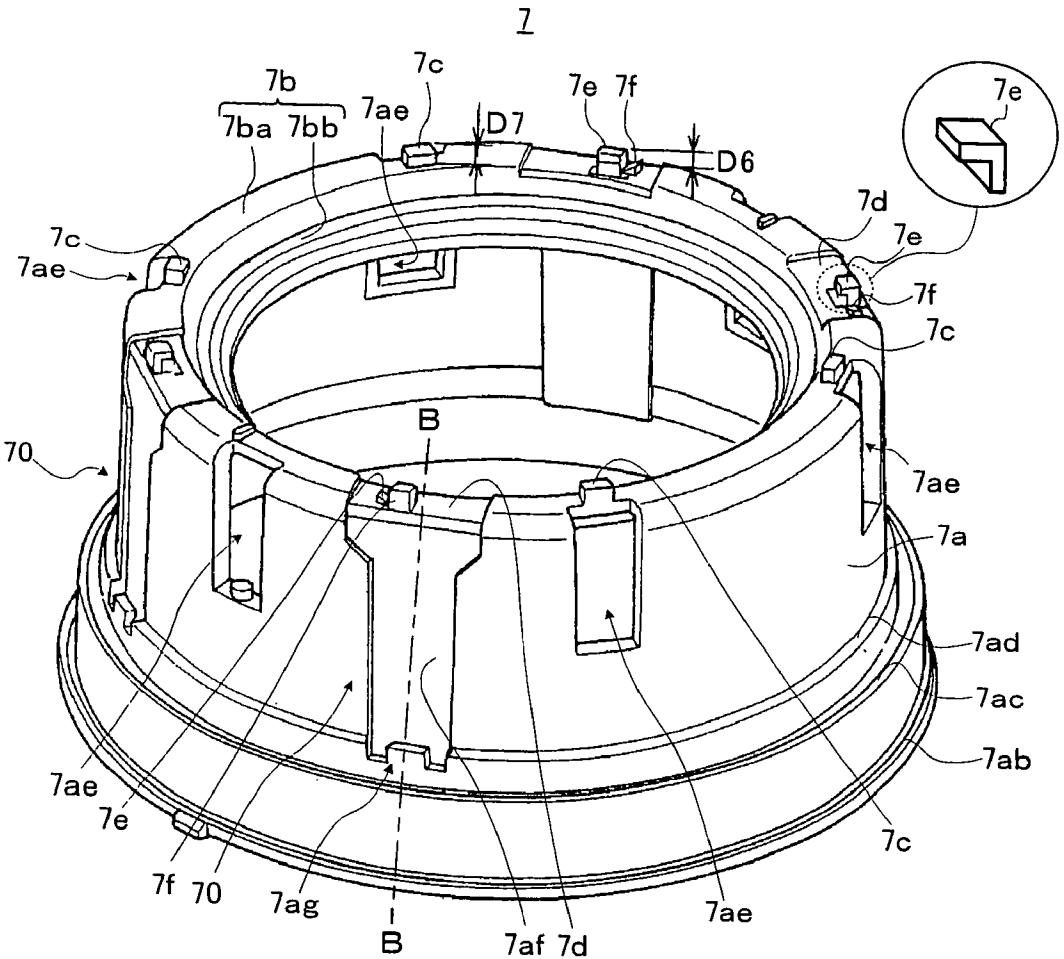

FIG. 7A is a perspective view showing the configuration of the connecting member 7. FIG. 7B shows a cross-sectional view along a cutting line B-B' shown in FIG. 7A.

The connecting member 7 has the cylindrical part 7*a* formed into the substantially cylindrical shape and the curved part 7*b* inwardly curved from the upper end portion of the cylindrical part 7*a*.

The cylindrical part 7*a* has the first flange part 7*ab*, the second flange part 7*ac*, the third flange part 7*ad*, plural ventilation holes 7*ae*, plural recessed parts 7*af* and plural mounting bases 7*ag*.

The first flange part 7*ab* is provided at the lower end portion of the cylindrical part 7*a*. The inner peripheral edge portion of the damper 8*a* is mounted on the first flange part 7*ab* (see FIG. 2). The second flange part 7*ac* is provided at the position in the vicinity of the lower end portion of the cylindrical part 7*a* and on the upper side of the first flange part 7*ab*. The inner peripheral edge portion of the conductive damper 8*b* is mounted on the second flange part 7*ac* (see FIG. 2). The third flange part 7*ad* is provided at the position in the vicinity of the lower end portion of the cylindrical part 7*a* and on the upper side of the second flange part 7*ac*. The inner peripheral edge portion of the diaphragm 10 is mounted on the third flange part 7*ad* (see FIG. 2). Each of the ventilation holes 7*ae* is provided at a position corresponding to each of the ventilation holes 5*a* of the voice coil bobbin 5 when the connecting member 7 is mounted on an appropriate position of the voice coil bobbin 5 (see FIG. 5). With each of the ventilation holes 5*a* of the voice coil bobbin 5, each of the ventilation holes 7*ae* has a function to output, to the outside of the speaker device 100, the heat generated in the voice coil 6 at the time of the driving of the speaker device 100. Each of the recessed parts 7*af* is formed larger than an outside size of the standing part 25*b* of the terminal member 25, and it is provided at a substantially intermediate position of the ventilation holes 7*ae* next to each other. Each of the mounting bases 7*ag* is provided at a position corresponding to the third flange part 7*ad* and each of the recessed parts 7*af*. Each of the mounting bases 7*ag* has a groove 7*ah* into which the above-mentioned mounting part 25*c* of the terminal member 25 is inserted. Each of the mounting bases 7*ag* has a function to fix the mounting part 25*c* by inserting the mounting part 25*c* of each of the terminal members 25 into the groove 7*ah*.

The curved part 7*b* has a flat surface 7*ba* having flatness, and a mounting base 7*bb* inwardly and downwardly extending from the inner peripheral edge portion of the flat surface 7*ba* and mounted on the outer peripheral wall of the voice coil bobbin 5. Plural projecting parts 7*c*, plural recessed parts 7*d*, the plural pairs of hook-shaped projecting parts 7*e* and claw parts 7*f* are provided on the flat surface 7*ba*. Each of the projecting parts 7*c* is provided at a position corresponding to each of the ventilation holes 7*ae* other than some parts of the plural ventilation holes 7*ae* to project from the flat surface 7*ba*. Each of the recessed parts 7*d* is provided at a position corresponding to the substantially intermediate position of the ventilation holes 7*ae* next to each other, and each of the recessed parts 7*d* is connected to each of the recessed parts 7*af*. Each pair of hook-shaped projecting parts 7*e* and claw parts 7*f* is provided at the substantially center position on each of the recessed parts 7*d*. Each of the claw parts 7*f* has a substantially triangle cross-sectional shape. As shown by an enlarged illustration, each of the hook-shaped projecting parts 7*e* is formed into the hook shape. Each of the hook-shaped projecting parts 7*e*, which is engaged with the projecting part 25*af* of each of the terminal members 25, has a function to fix the upper end portion of each of the terminal members 25 to the upper end portion of the connecting member 7. In addition, each of the claw parts 7*f*, which is engaged with the opening 25*ac* of each of the terminal members 25, has a function to fix the upper end portion of each of the terminal member 25 to the upper end portion of the connecting member 7 with each of the hook-shaped projecting parts 7*e*. When the flat surface 7*ba* is prescribed as a reference surface, a distance D7 from the reference surface to the upper end surface of each of the projecting parts 7*c* is set to be relatively larger than a distance D6 from the reference surface to the upper end surface of each of the hook-shaped projecting parts 7*e*. Therefore, the upper end surface of each of the projecting parts 7*c* is upwardly positioned with respect to the upper end surface of each of the hook-shaped projecting parts 7*e*. In a preferred example, when the distance D7 from the reference surface to the upper end surface of each of the projecting parts 7*c* is set to substantially 1.3 mm, the distance D6 from the reference surface to the upper end surface of each of the hook-shaped projecting parts 7*e* is preferably set to substantially 1.1 mm. In this embodiment, the above-mentioned pair of hook-shaped projecting part 7*e* and claw part 7*f*, the recessed part 7*d*, the recessed part 7*af* and the mounting base 7*ag* including the groove 7*ah* are referred to as "terminal mounting part 70" as a whole.

Next, a description will be given of the fixing configuration of the terminal member 25 and the connecting member 7 characterized by the present invention, with reference to FIG. 8 and FIGS. 9A and 9B.

Figure 8:
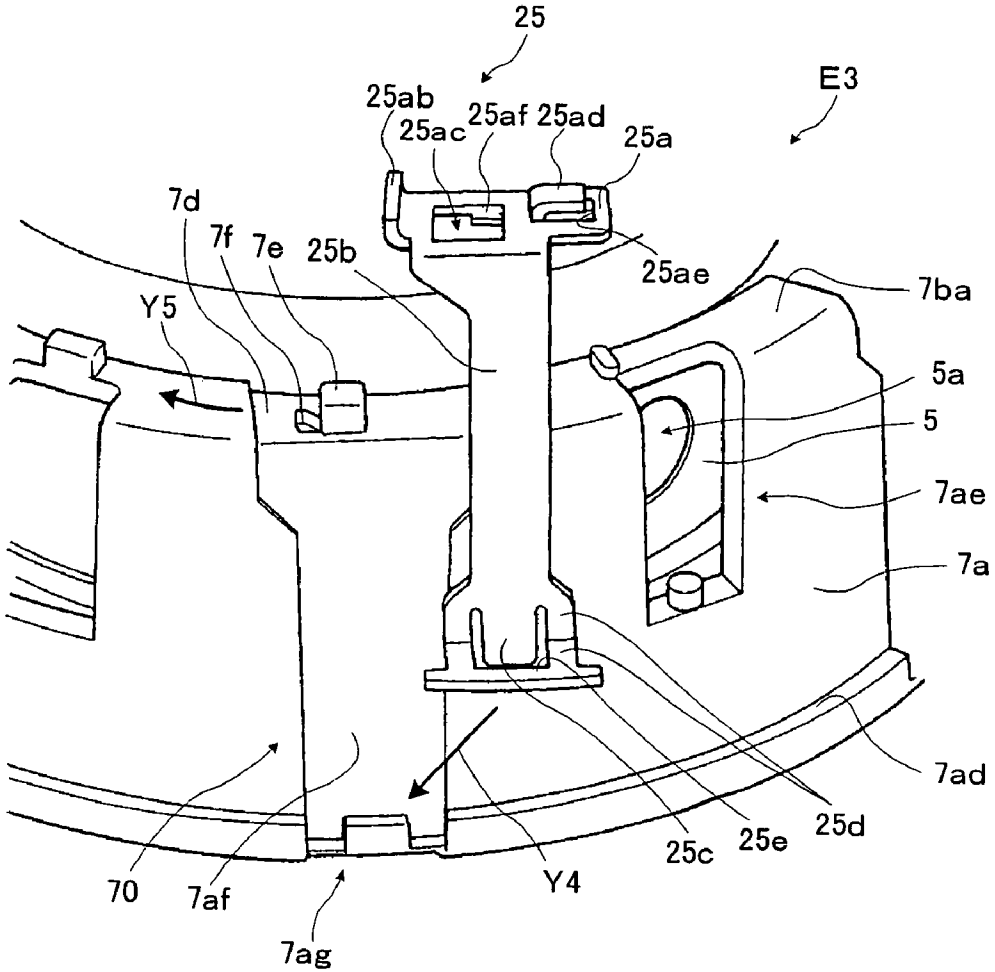
FIG. 8 is a partly-enlarged perspective view of the connecting member for explaining a method of mounting the terminal member on the terminal mounting part of the connecting member.
Figure 9B:
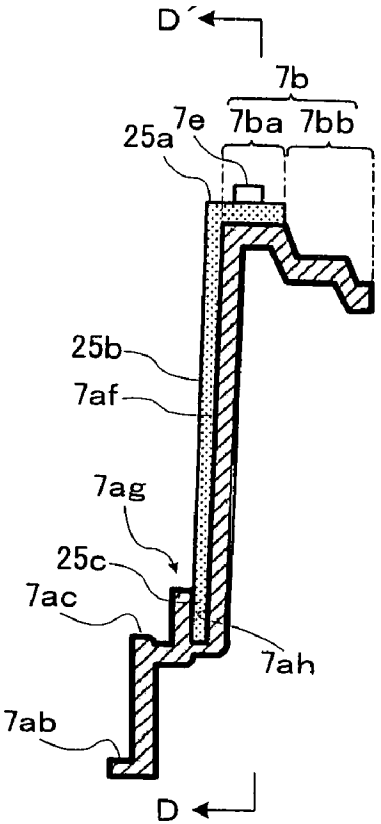
FIGS. 9A and 9B are a partly-enlarged perspective view and a cross-sectional view showing such a state that the terminal member is mounted on the terminal mounting part of the connecting member, respectively.
Figure 9A:
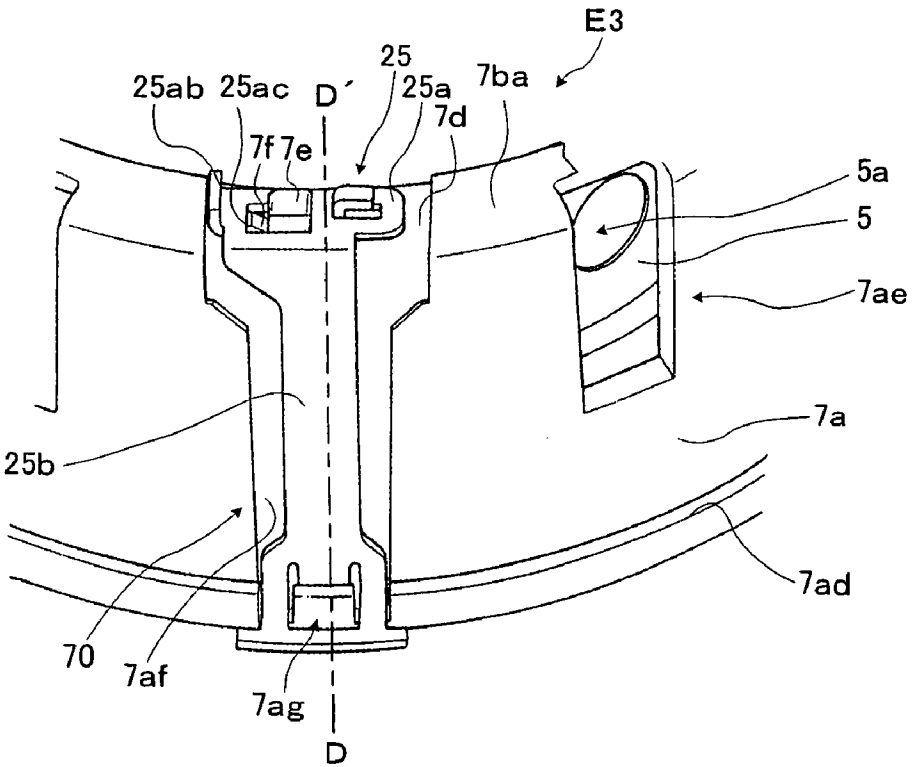

FIG. 8 is a partly-enlarged perspective view corresponding to the vicinity of a broken-line area E3 shown in FIG. 5, and it is also a partly-enlarged perspective view showing a state before the terminal member 25 is mounted on the terminal mounting part 70 of the connecting member 7. FIG. 9A is a partly-enlarged perspective view corresponding to FIG. 8, and it is also a partly-enlarged perspective view showing a state after the terminal member 25 is mounted on the terminal mounting part 70 of the connecting member 7. FIG. 9B is a partly cross-sectional view along a cutting-plane line D-D' shown in FIG. 9A.

Such a process that the terminal member 25 is mounted on and fixed to the terminal mounting part 70 of the connecting member 7 is executed in an order explained below. First, as shown in the direction of an arrow Y4, the mounting part 25*c* of the terminal member 25 is inserted into the groove 7*ah* of the connecting member 7 from the obliquely upper direction, and the standing part 25*b* of the terminal member 25 is arranged in the recessed part 7*af* of the connecting member 7. Further, in such a state that the part of the pair of hook-shaped projecting part 7*e* and claw part 7*f* of the connecting member 7 is temporarily inserted into the opening 25*ac* provided at the top board part 25*a* of the terminal member 25, the top board part 25*a* of the terminal member 25 is arranged in the recessed part 7*d* of the connecting member 7. In such a state, the pair of hook-shaped projecting part 7*e* and claw part 7*f* is not completely inserted into the opening 25*ac*. Next, with using the mounting base 7*ag* of the connecting member 7 as the fulcrum, as shown by an arrow Y5, the projecting part 25*ab* of the terminal member 25 is moved (slid) in the circumferential direction of the connecting member 7, and the pair of hook-shaped projecting part 7*e* and claw part 7*f* is engaged with the opening 25*ac*. This work can be performed via hands. Such a state that the terminal member 25 is thus mounted on the terminal mounting part 70 is shown in FIG. 9A. When the side of the top board part 25*a* of the terminal member 25 (i.e., the side of the upper end portion) is focused in FIG. 9A, the pair of hook-shaped projecting part 7*e* and claw part 7*f* is engaged with the opening 25*ac* in such a state shown in the enlarged illustration in FIG. 4A. Meanwhile, when the side of the mounting part 25*c* of the terminal member 25 (i.e., the side of the lower end portion) is focused in FIGS. 9A and 9B, the mounting part 25*c* of the terminal member 25, which is inserted into the recessed part 7*af* of the connecting member 7, is fixed to the mounting base 7*ag* of the connecting member 7.

Figure 10:
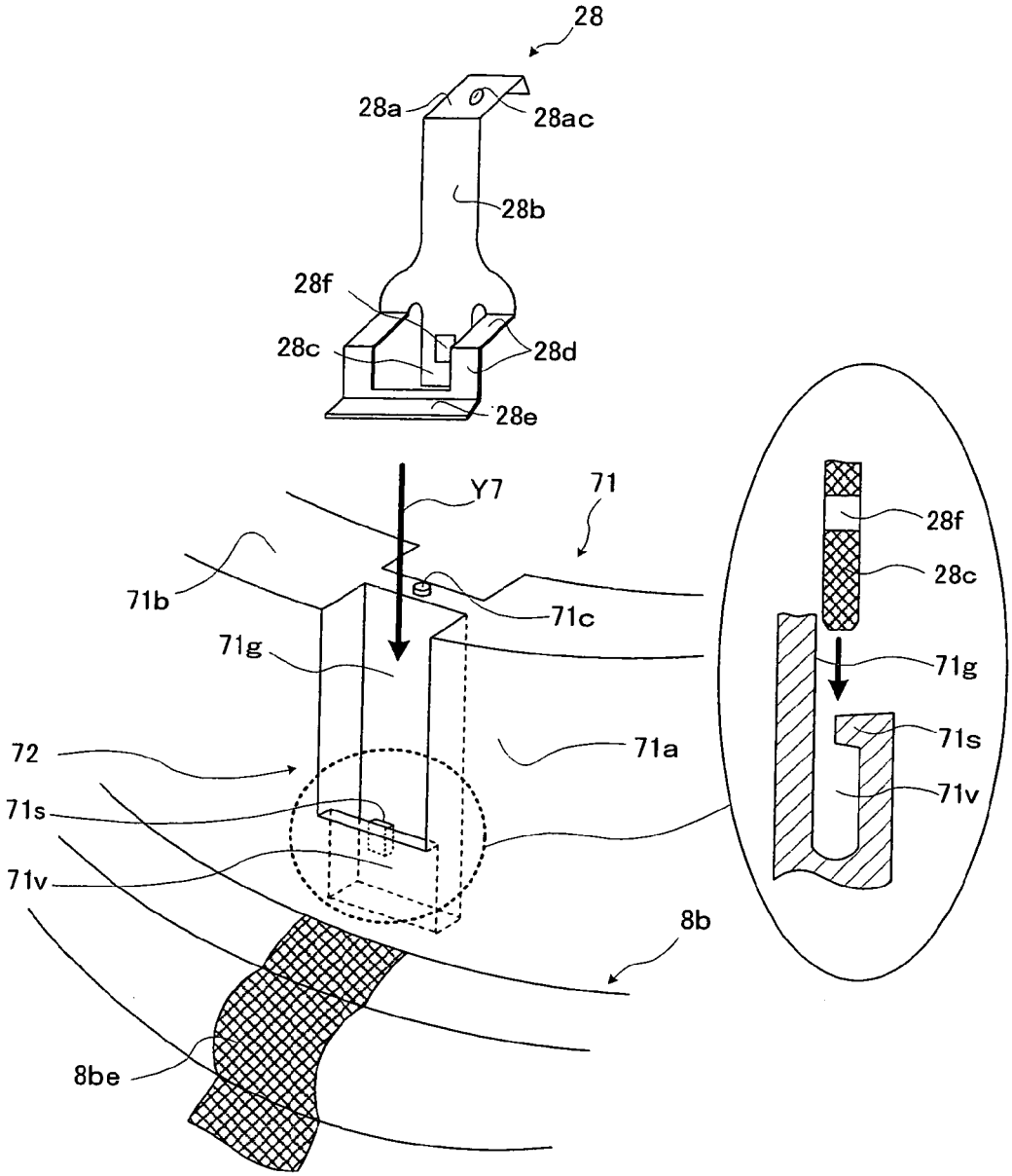
FIG. 10 is a partly-enlarged perspective view of the connecting member for explaining the method of mounting the terminal member on the terminal mounting part of the connecting member, according to a comparative example.

Next, a description will be given of characteristic operation and effect of the speaker device 100 according to the embodiment of the present invention, as compared with a comparative example. FIG. 10 is a partly-enlarged perspective view explaining a mounting method of a terminal member 28 (corresponding to the terminal member 25 in this embodiment) and a connecting part 71 (corresponding to the connecting member 7 in this embodiment) according to the comparative example. Configurations of components which will not be particularly explained in the comparative example are substantially same as those of this embodiment.

Before the characteristic operation and effect of this embodiment are explained, a description will be given of the configurations of the terminal member 28 and the connecting member 71 according to the comparative example, a mounting method of the terminal member 28 on the connecting member 71, and the operation and effect thereof, with reference to FIG. 10.

First, a description will be given of the configuration of the terminal member 28. The terminal member 28 has a top board part 28*a*, a standing part 28*b*, a mounting part 28*c*, a curved part 28*d* and a connecting part 28*e*, and it is formed into a shape shown in FIG. 10. An opening 28*ac* is formed at the substantially center of the top board part 28*a*, and an opening 28*f* is formed at the substantially center of the mounting part 28*c*, respectively. Subsequently, the configuration of the connecting member 71 will be explained. The connecting member 71 has a cylindrical part 71*a* formed into a substantially cylindrical shape. At an appropriate position on the outer peripheral wall 71*a* of the cylindrical part 71, a terminal mounting part 72 for mounting the terminal member 28 is provided. The terminal mounting part 72 has a projecting part 71*c* upwardly projecting from an upper end surface 71*b* of the cylindrical part 71*a*, a recessed part 71*g* for receiving the terminal member 28, a groove 71*v* positioned on the lower side of the recessed part 71*g* and a projecting part 71*s* formed on the inner peripheral wall of the cylindrical part 71*a* corresponding to the groove 71*v*.

Next, a description will be briefly given of the mounting method of the terminal member 28 on the connecting member 71.

As the mounting method, first, the terminal member 28 is moved from the upper position of the terminal mounting part 72 to the side of the terminal mounting part 72 (in the direction of an arrow Y7), and the projecting part 71*c* of the connecting member 71 is inserted into the opening 28*ac* of the terminal member 28. At the same time, the standing part 28*b* of the terminal member 28 is arranged in the recessed part 71*g* of the connecting member 71, and further the mounting part 28*c* of the terminal member 28 is inserted into the groove 71*v* of the connecting member 71. In the state, the terminal member 28 is further inserted into the direction of the arrow Y7, and the projecting part 71*s* of the connecting member 71 and the opening 28*f* of the terminal member 28 are engaged with each other. In this manner, the terminal member 28 is mounted on the terminal mounting part 72 of the connecting member 71.

The comparative example having such a mounting method has a problem to be solved, as will be described below. The problem will be explained with reference to FIG. 2 according to this embodiment. FIG. 2 shows the cross-sectional view of the speaker device 100 according to this embodiment. However, as described above, this embodiment is different from the comparative example only in the configurations of the connecting member and the terminal member. Therefore, by assuming that the connecting member 7 and the terminal member 25 shown in FIG. 2 are changed into the above-mentioned connecting member 71 and terminal member 28 according to the comparative example, the explanation will be given below.

In the comparative example, the above-mentioned mounting work is executed after the connecting member 71 attached to the voice coil bobbin 5 is arranged at the predetermined position in the magnetic circuit. As described above, in the comparative example, the opening 28*f* of the terminal member 28 has to be securely engaged with the projecting part 71*s* of the connecting member 71 so that the terminal member 28 is mounted on the terminal mounting part 72 of the connecting member 71. Therefore, while the terminal member 28 is moved in the direction opposite to the arrow Y1, i.e., on the side of the magnetic circuit 30, the terminal member 28 has to be mounted on the terminal mounting part 72 of the connecting member 71 with adding a constant external force. Hence, in the comparative example, each of the components such as the connecting member 71, the voice coil bobbin 5, the damper 8*a* and the conductive damper 8*b*, which are shown in the broken-line area E1 in FIG. 2, is sometimes mounted in such a state that each of them is shifted with respect to the originally appropriate position, e.g., in such a state that each of the components is obliquely downwardly shifted (i.e., shifted in the direction of the arrow Y2). Due to this, in the comparative example, the vibration system 31 cannot appropriately operate at the time of the driving of the speaker device, and there occurs the difference of the sensitivity (sound pressure level). Thus, the sound quality is problematically deteriorated.

On the other hand, in this embodiment, the above-mentioned fixing configuration of the terminal member 25 and the connecting member 7 is employed. Therefore, no problem occurs unlike the comparative example.

Namely, similarly to the comparative example, in this embodiment, the mounting work of the terminal member 25 on the connecting member 7 is performed after the connecting member 71 attached to the voice coil bobbin 5 is arranged at the predetermined position in the magnetic circuit.

Particularly, in this embodiment, each of the terminal members 25 has the projecting part 25*ab* functioning to move the upper end portion of the terminal member 25 in the circumferential direction of the connecting member 7 with using the mounting base 7*ag* as the fulcrum in such a state that the mounting part 25*c* is inserted into the groove 7*ah* of the connecting member 7. Therefore, in the manufacturing process of the speaker device 100, in such a state that the mounting part 25*c* of the terminal member 25 is inserted into the groove 7*ah* of the connecting member 7 from the obliquely upper direction, the projecting part 25*ab* of the terminal member 25 is moved (slid) to the circumferential direction of the connecting member 7, not to the direction opposite to the arrow Y1, with using the mounting base 7*ag* of the connecting member 7 as the fulcrum. Further, the pair of hook-shaped projecting part 7*e* and claw part 7*f* is engaged with the opening 25*ac*. Thereby, the terminal member 25 can be mounted on the terminal mounting part 70. According to the mounting method, when the terminal member 25 is mounted on the connecting member 7, there operates no external power for moving the voice coil bobbin 5 integrated with the connecting member 7 to the side of the magnetic circuit 30. Therefore, each of the components such as the connecting member 7, the voice coil bobbin 5, the damper 8*a* and the conductive damper 8*b* is never mounted in such a state that each of them is obliquely downwardly shifted (i.e., shifted to the direction of the arrow Y2) with respect to the originally appropriate position as shown in the comparative example. Namely, by the mounting method, the voice coil bobbin 5 can be mounted on the appropriate position in the vibration system 31 and the magnetic circuit 30. Thus, in this embodiment, the vibration system 31 can appropriately operate at the time of the driving of the speaker device 100. As a result, in this embodiment, there occurs no difference of the sensitivity (sound output level), and the deterioration of the sound quality can be securely prevented.

Figure 11A:
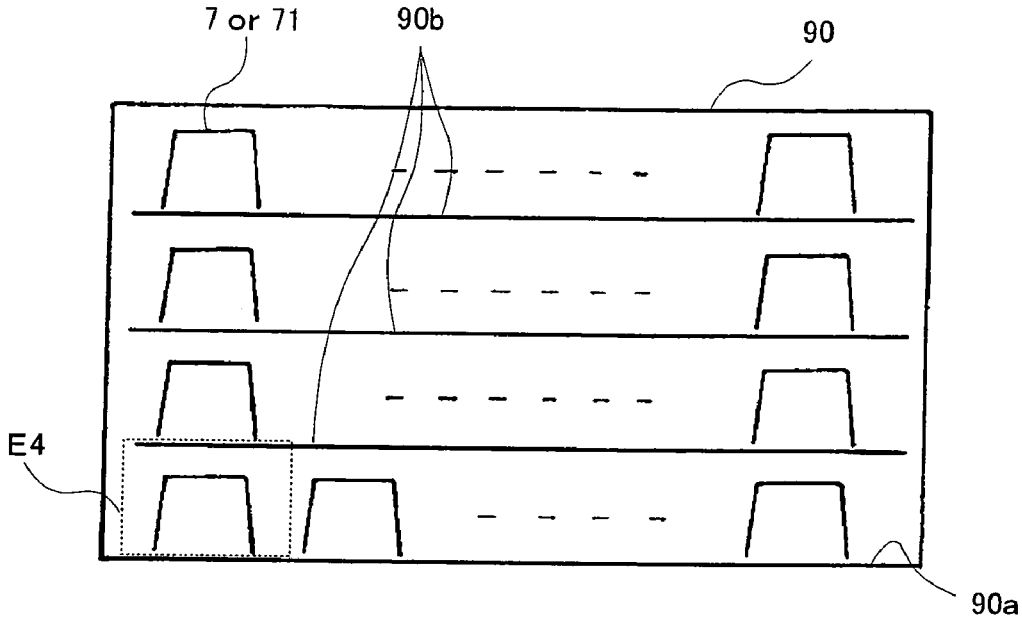
FIGS. 11A and 11B show side-surface views in such a state that the plural connecting members are housed into a packing box.
Figure 11B:
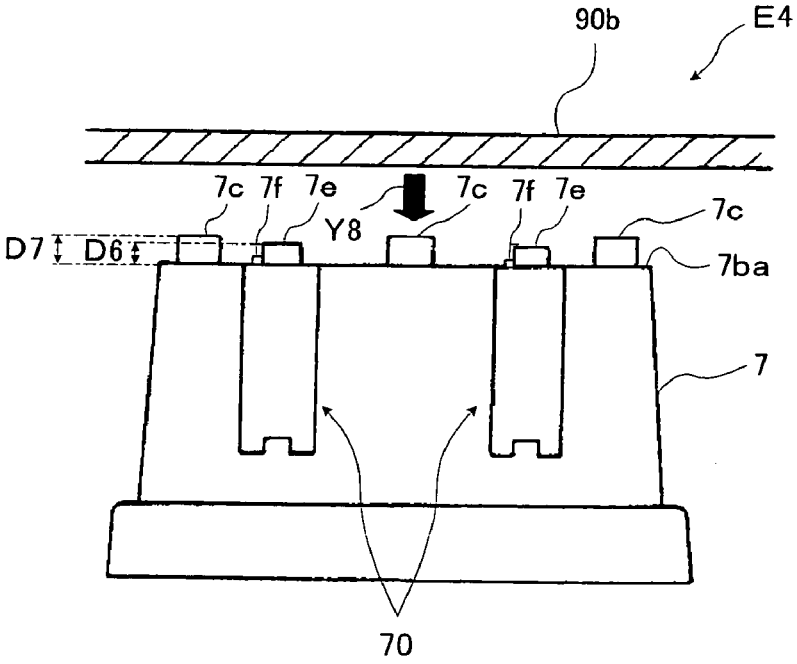

Additionally, this embodiment also includes characteristic operation and effect which will be described below, as compared with the above-mentioned comparative example. As for this point, an explanation will be given with reference to FIGS. 11A and 11B. FIG. 11A is a side view shown by seeing through such a state that the plural connecting members 25 being completed products are housed into a packing box 90. FIG. 11B is a partly-enlarged side view showing an enlarged part corresponding to a broken-line area E4 shown in FIG. 11A, and it is also a partly-enlarged side view showing a positional relation between the connecting member 7 according to this embodiment and a partition board 90*b*.

The packing box 90 may be a corrugated fiber board box, for example. As shown in FIG. 11A, the plural connecting members are housed into the packing box 90 in a manner shown in the drawing. Namely, the connecting members 7 or connecting members 71 of the predetermined number are arranged on a bottom part 90*a* of the packing box 90, and a plane partition board 90*b* is arranged on the predetermined number of connecting members 7 or connecting members 71. Similarly, the connecting members 7 or connecting members 71 of the predetermined number are arranged on the partition board 90*b*, and the connecting members 7 or connecting members 71 of the predetermined number are further arranged on the partition board 90*b*. The above-mentioned configuration is repeated on an upper configuration thereon.

As described above, in the comparative example, the projecting part 71*c* functioning to fix the terminal member 28 to the connecting member 71 is provided at the terminal mounting part 72 of the connecting member 71. Therefore, when the connecting member 71 is housed into the packing box 90, or when the packing box 90 housing the plural connecting members 71 is transported, if the impact of some kind is added to the packing box 90, the partition board 90*b* and the projecting part 71*c* collide with each other and the projecting part 71*c* is folded down. Thereby, the projecting part 71*c* is problematically broken. Therefore, in the comparative example, a large number of connecting members 71 cannot be housed into the packing box 90 by the above-mentioned method, and transportation efficiency of the connecting members 71 is problematically decreased.

On the other hand, in this embodiment, as shown in FIGS. 7A and 7B and FIG. 11B, the connecting member 7 includes the plural projecting parts 7*c*, in addition to the plural hook-shaped projecting parts 7*e* functioning to fix the terminal member 25 to the terminal mounting part 70 of the connecting member 7. The plural projecting parts 7*c* are provided on the flat surface 7*ba* of the connecting member 7 and at position overlapping with no annular projecting part 7*e* with appropriate spaces. In addition, when the flat surface 7*ba* is prescribed as the reference surface, the distance D7 from the reference surface to the upper end surface of each of the projecting parts 7*c* is set to be relatively larger than the distance D6 from the reference surface to the upper end surface of each of the hook-shaped projecting parts 7*e*. Thus, the upper end surface of each of the projecting parts 7*c* is upwardly positioned with respect to the upper end surface of each of the hook-shaped projecting parts 7*e*. In a preferred example, when the distance D7 from the reference surface to the upper end surface of each of the projecting parts 7*c* is set to substantially 1.3 mm, the distance D6 from the reference surface to the upper end surface of each of the hook-shaped projecting parts 7*e* can be set to substantially 1.1 mm.

Hence, when the connecting member 7 is housed into the packing box 90, or when the packing box 90 housing the plural connecting members 7 is transported, even if the impact of some kind is added to the packing box 90, a part of the connecting member 7 colliding with the partition board 90*b* is each of the projecting parts 7*c*, and the partition board 90*b* and each of the hook-shaped projecting parts 7*e* never collide with each other. Namely, each of the projecting parts 7*c* has the function to prevent each of the hook-shaped projecting parts 7*e* and each of the partition boards 90*b* from colliding with each other. Thereby, in this embodiment, in such a state that a large number of connecting members 7 are housed into the packing box 90 by the above-mentioned method, the packing box 90 can be transported without damaging the hook-shaped projecting part 7*e* of each of the connecting members 7. As a result, the transportation efficiency of the connecting members 7 can be improved.

[Manufacturing Method of Speaker Device]

Figure 12:
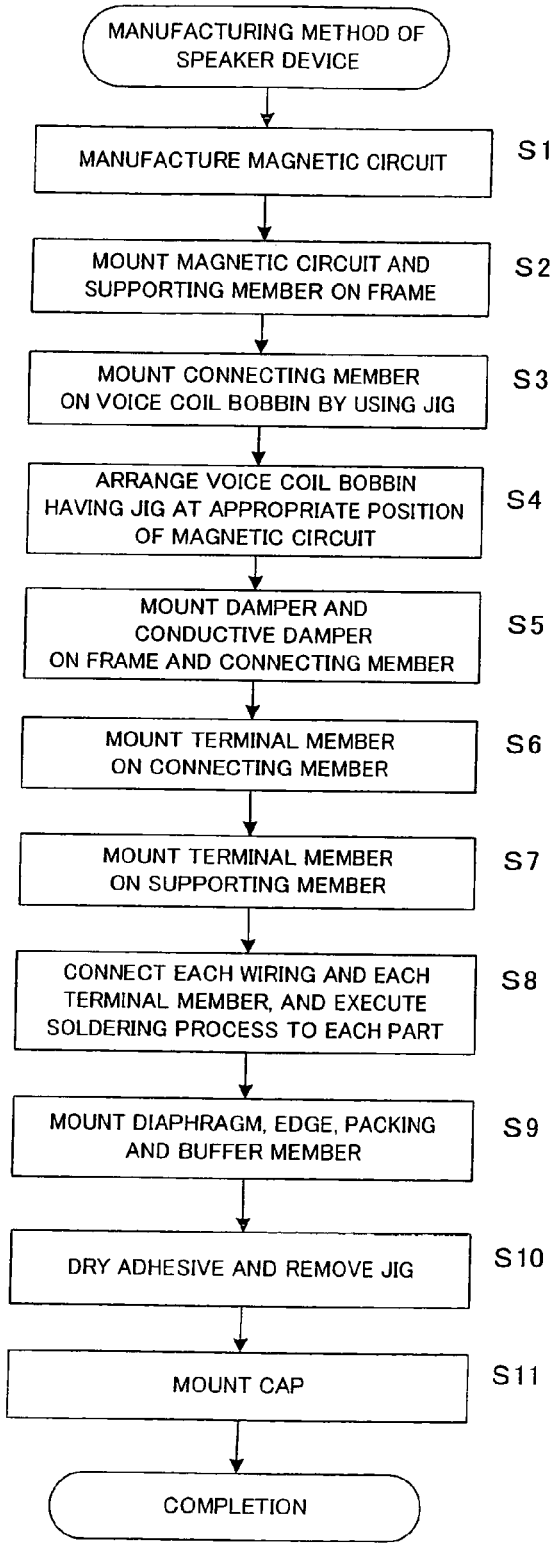
FIG. 12 is a flow chart showing a manufacturing method of the speaker device according to the embodiment of the present invention.

Next, a description will be given of the manufacturing method of the speaker device 100 according to the above-mentioned embodiment, with reference to FIG. 12 to FIG. 18. FIG. 12 is a flow chart showing the manufacturing method of the speaker device 100 according to this embodiment. FIG. 13 to FIGS. 16A to 16C show cross-sectional views corresponding to the respective manufacturing processes of the flow chart shown in FIG. 12. The configuration of each of the above-mentioned components is omitted below.

Figure 13:
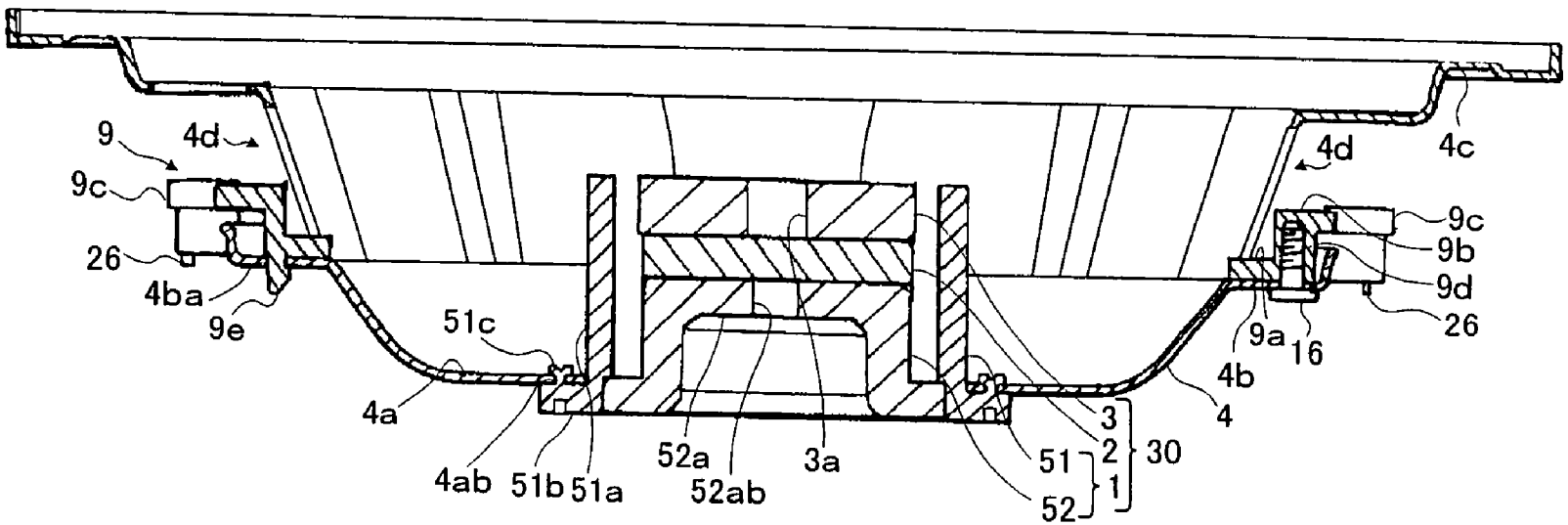
FIG. 13 is a cross-sectional view showing manufacturing steps of the speaker device according to the embodiment.

First, the magnetic circuit 30 is manufactured (step S1). Specifically, as shown in FIG. 13, the lower end portion of the inner peripheral wall of the main body part 51 formed into the substantially cylindrical shape is attached to the lower end portion of the outer peripheral wall of the bottom part 52 having the shape obtained by turning the substantially triangle shape upside down. Subsequently, the plate-like magnet 2 is mounted on the mounting part 52*a* of the bottom part 52 via an adhesive (not shown). Next, the annular plate 3 is mounted on the magnet 2 via the adhesive. In this manner, the magnetic circuit 30 is manufactured.

Next, the magnetic circuit 30 and the supporting member 9 are mounted on the frame 4 (step S2). Concretely, as understood with reference to FIG. 13, first, the frame 4 formed into the substantial cup shape is prepared. Each of the projecting parts 51*c* formed on the flange part 51*b* of the main body part 51 is inserted into each of the openings 4*ab* provided at the first flange part 4*a* of the frame 4, and the first flange part 4*a* is arranged on the flange part 51*b* of the main body part 51. Subsequently, by using a caulking jig (not shown), the upper end surface of each of the projecting parts 51*c* is caulked into a shape shown in FIG. 13. Thereby, the main body part 51 of the yoke 1 can be mounted on the frame 4. Next, as understood with reference to FIG. 13, the annular supporting member 9 is prepared and arranged on the second flange part 4*b* of the frame 4. Then, each of the claw parts 9*e* of the supporting member 9 is engaged with each of the openings 4*ba* provided at the second flange part 4*b*. In addition, each of the openings provided at the appropriate positions of the second flange part 4*b* and the screw hole 9*d* of the supporting member 9 are positioned, and the second flange part 4*b* and the supporting member 9 are screwed together by the bolt 16. Thereby, the supporting member 9 is mounted on the second flange part 4*b* of the frame 4.

Next, the connecting member 7 is mounted on the voice coil bobbin 5 by using jigs (step S3).

Figure 14:
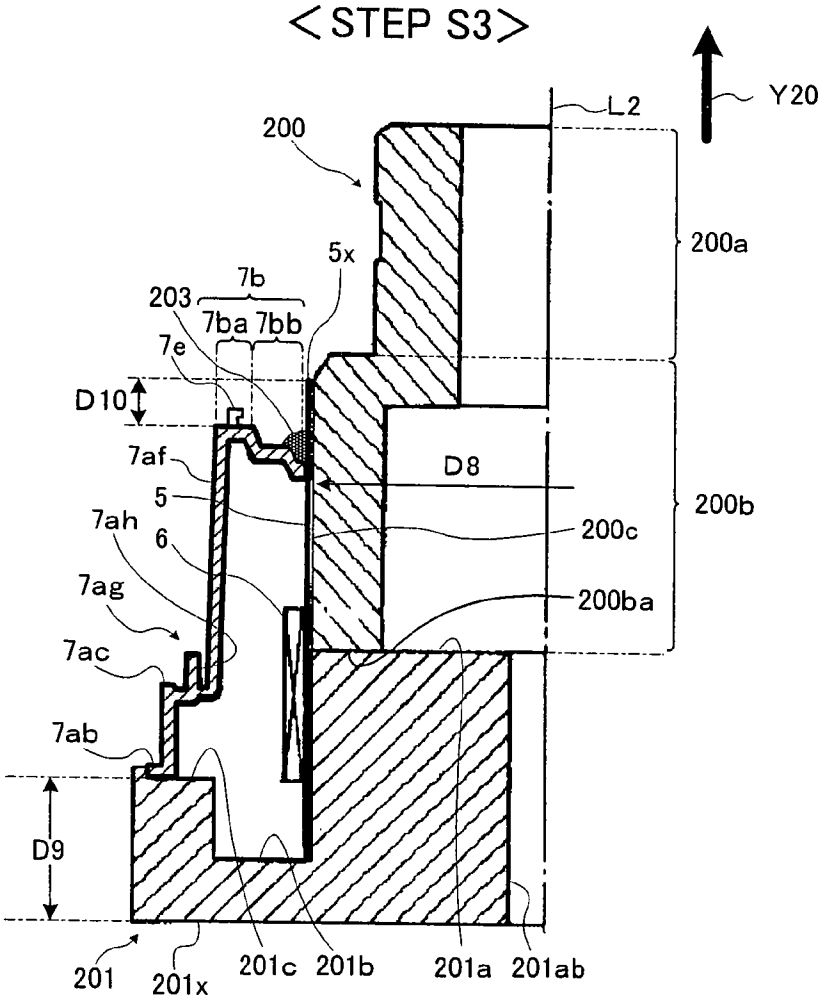
FIG. 14 is a cross-sectional view showing a manufacturing step of the speaker device according to the embodiment.

Concretely, as shown in FIG. 14, first, two jigs formed into shapes shown in the drawing, i.e., a voice coil gauge 200 and a positioning jig 201, are prepared. Before amounting method of them is explained, a description will be given of each configuration of the voice coil gauge 200 and the positioning jig 201. In FIG. 14, a straight line L2 shows a central axis of the voice coil gauge 200 and the positioning jig 201 in a case that they are integrated with each other.

The voice coil gauge 200 is made of a material such as a resin and metal, for example. The voice coil gauge 200 has a first cylindrical part 200*a* formed into a cylindrical shape, a second cylindrical part 200*b* having the outer diameter larger than that of the first cylindrical part 200*a*, arranged on the lower side of the first cylindrical part 200*a* and integrated with the first cylindrical part 200*a*, and a voice coil bobbin holding part 200*c* mounted on the outer peripheral wall of the second cylindrical part 200*b*. The voice coil bobbin holding part 200*c* is made of a material such as a resin film, for example. When the voice coil gauge 200 is made of the resin material, the first cylindrical part 200*a*, the second cylindrical part 200*b* and the voice coil bobbin holding part 200*c* are preferably integrated with each other (hereinafter, the voice coil gauge in this form is referred to as "resin-integrated voice coil gauge"). An outer diameter D8 of the voice coil bobbin holding part 200*c* is set to a value slightly smaller than an inner diameter of the voice coil bobbin 5. The voice coil bobbin 5 is attachably and detachably mounted on the outer peripheral wall of the voice coil bobbin holding part 200*c*. Additionally, a lower end surface 200*b* a of the second cylindrical part 200*b* has flatness.

The positioning jig 201 is used in a state of being attached to the voice coil gauge 200, and it has a function to mount the connecting member 7 on the appropriate position of the outer peripheral wall of the voice coil bobbin 5. The positioning jig 201 has a cylindrical part 201*a* formed into a substantially cylindrical shape, a flange part 201*b* outwardly extending from the lower end portion of the outer peripheral wall of the cylindrical part 201*a* and having a step part 200*bb* (see FIG. 15B), and an annular projecting part 201*c* upwardly projecting from the outer peripheral wall of the flange part 201*b*, which are integrated with each other. At a center of the cylindrical part 201*a*, a through hole 201*ab* is formed. An outer diameter of the cylindrical part 201*a* is set to the substantially same value as that of the second cylindrical part 200*b* of the voice coil gauge 200. In a case of the resin-integrated voice coil gauge, the outer diameter of the cylindrical part 201*a* is set to the substantially same value as the inner diameter of the voice coil bobbin holding part 200*c*.

A description will be given of the method of mounting the connecting member 7 on the voice coil bobbin 5 by using the two jigs when the voice coil gauge 200 and the positioning jig 201 having the above-mentioned configurations are prepared, with reference to FIG. 14 to FIGS. 16A to 16C. FIGS. 15A to 15C and FIGS. 16A to 16C show the mounting process of the connecting member 7 on the voice coil bobbin 5 by using the voice coil gauge 200 and the positioning jig 201. In FIGS. 15A to 15C and FIGS. 16A to 16C, the same reference numerals are given to the same components as those shown in FIG. 14, and explanations thereof are omitted.

Figure 15A:
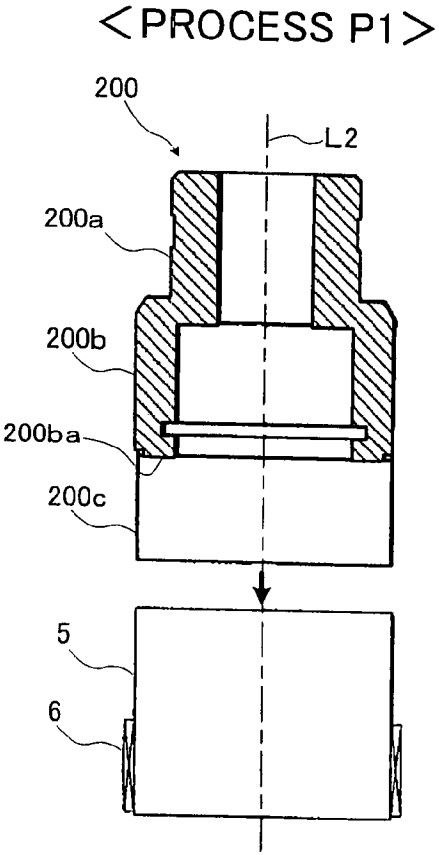
FIGS. 15A to 15C are cross-sectional views showing manufacturing processes of the speaker device according to the embodiment.
Figure 15B:
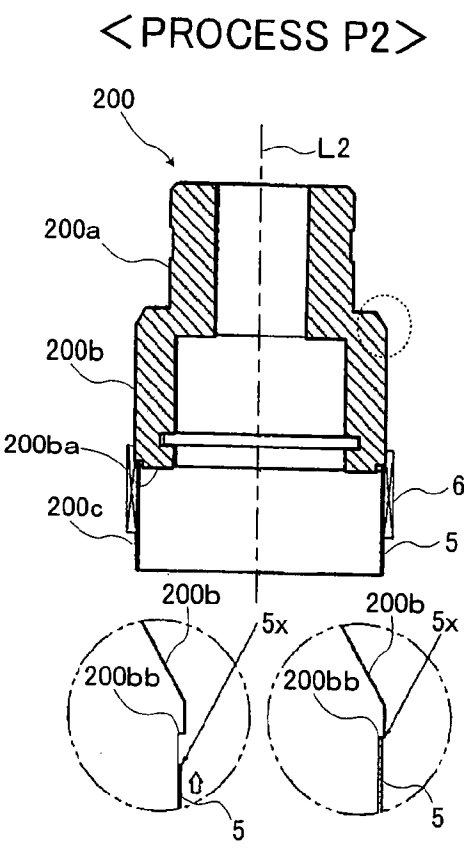

First, as shown in FIG. 15A, the voice coil bobbin 5 around which the voice coil 6 is wound in advance is prepared, and the voice coil gauge 200 is inserted into the voice coil bobbin 5 (process P1). Subsequently to the state, as shown by enlarging a broken-line part (two area parts positioned on the lower side of the voice coil gauge 200) shown in FIG. 15B, the voice coil gauge 200 is further inserted into the voice coil bobbin 5 until an upper end surface 5*x* of the voice coil bobbin 5 and the step part 200*bb* of the second cylindrical part 200*b* contact with each other (process P2).

Figure 15C:
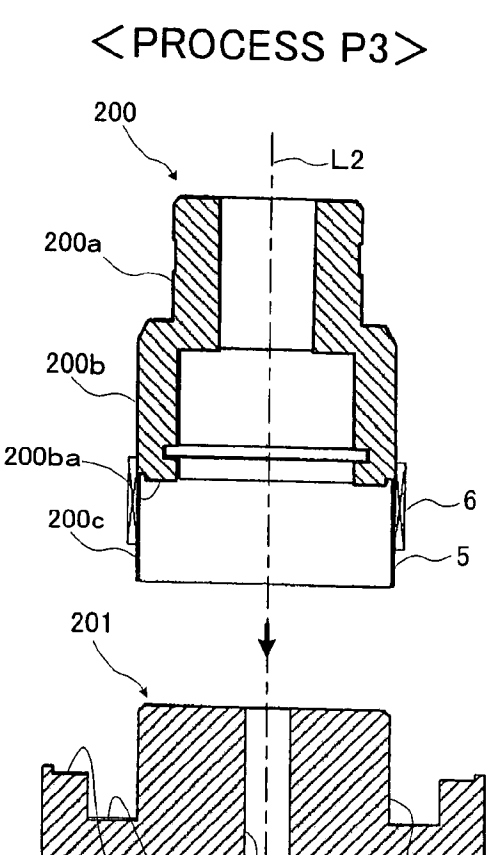
Figures 16A, 16B, 16C:
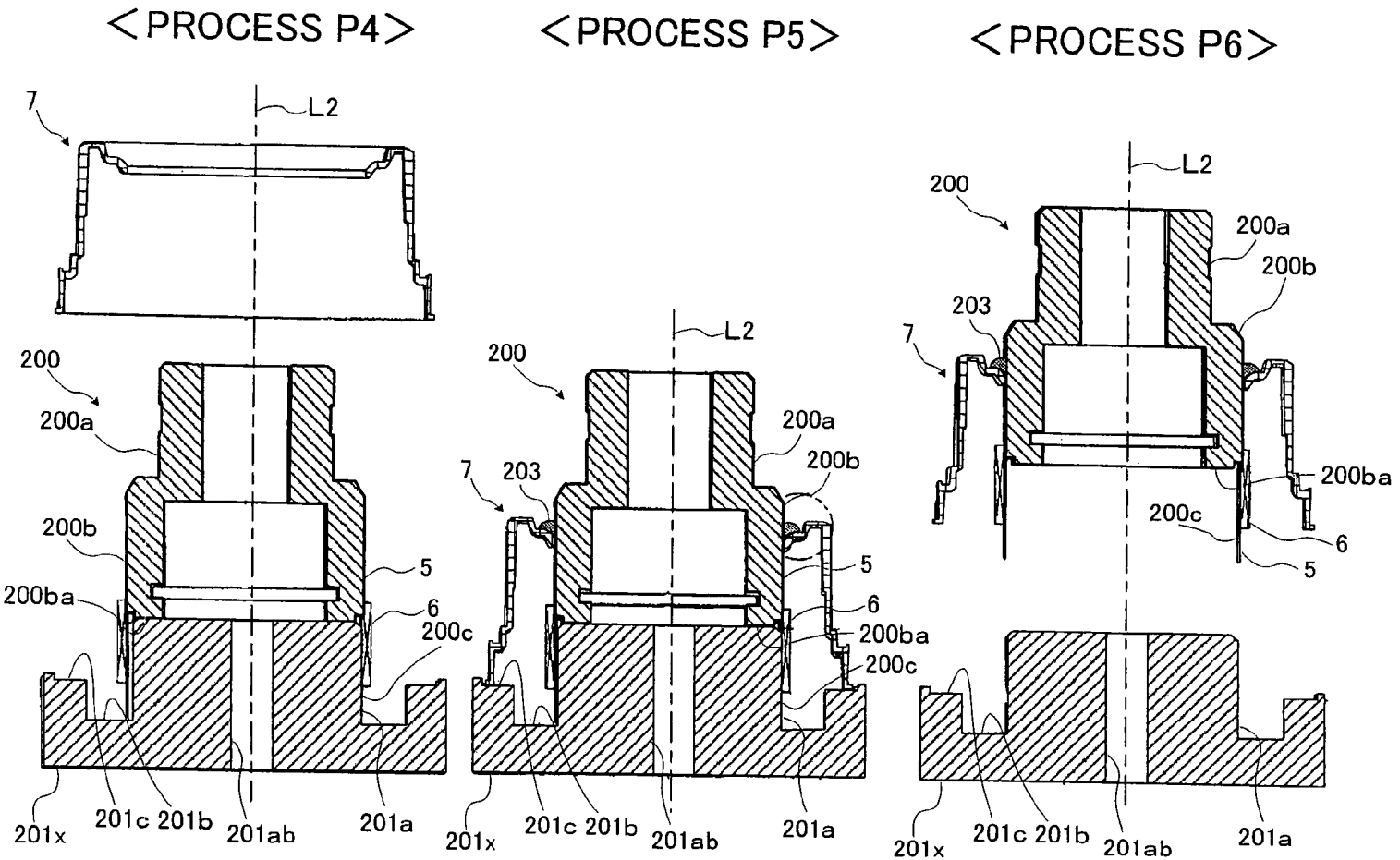
FIGS. 16A to 16C are cross-sectional views showing manufacturing processes of the speaker device according to the embodiment.

Subsequently, as shown in FIG. 15C, the voice coil bobbin 5 attached to the voice coil gauge 200 is inserted into the positioning jig 201, and they are integrated with each other (process P3). FIG. 16A shows an object formed by integrating the voice coil bobbin 5, the voice coil gauge 200 and the positioning jig 201 (hereinafter, simply referred to as "first integrated object"). At this time, as shown in FIG. 14 and FIG. 16A, in such a state that the lower end surface 200*ba* of the voice coil gauge 200 contacts the upper surface of the cylindrical part 201*a* of the positioning jig 201 and in such a state that the outer peripheral wall of the cylindrical part 201*a* of the positioning jig 201 contacts the inner peripheral wall of the voice coil bobbin holding part 200*c* the voice coil gauge 200 is attachably and detachably integrated with the voice coil bobbin 5.

Subsequently, as shown in FIG. 16A, the connecting member 7 is prepared, and the above-mentioned first integrated object is inserted into the connecting member 7 until the lower end portion of the connecting member 7 contacts the upper surface of the annular projecting part 201*c* of the positioning jig 201 (process P4). Thereby, as shown in FIG. 14, a distance from a lower end surface 201*x* of the positioning jig 201 to the upper surface of the annular projecting part 201*c* is set to D9. The distance D9 is set to a value at which the connecting member 7 can be mounted at the appropriate position on the outer peripheral wall of the voice coil bobbin 5, i.e., a value ensuring an appropriate distance D10 (distance in the direction of the straight line L2) from the upper end surface 5*x* of the voice coil bobbin 5 to the flat surface 7*ba* of the connecting member 7. According to one of various kinds of use of the speaker device, the distance D10 can be set to a desired value by varying the distance D9 from the lower end surface 201*x* of the positioning jig 201 to the upper surface of the annular projecting part 201*c*. In this manner, the connecting member 7 is arranged at the appropriate position on the outer peripheral wall of the voice coil bobbin 5.

Subsequently, as shown in FIG. 16B, an adhesive 203 is applied between the inner peripheral edge portion (mounting base 7*bb*) of the connecting member 7 and the outer peripheral wall of the voice coil bobbin 5, and the adhesive 203 is completely dried (process P5). A time period for drying can be set to substantially 15 minutes, for example. Then, as shown in FIG. 16C, an object by mounting the connecting member 7 and the voice coil bobbin 5 on the voice coil gauge 200 (hereinafter, simply referred to as "second integrated object") is removed from the positioning jig 201 (process P6).

Figure 17:
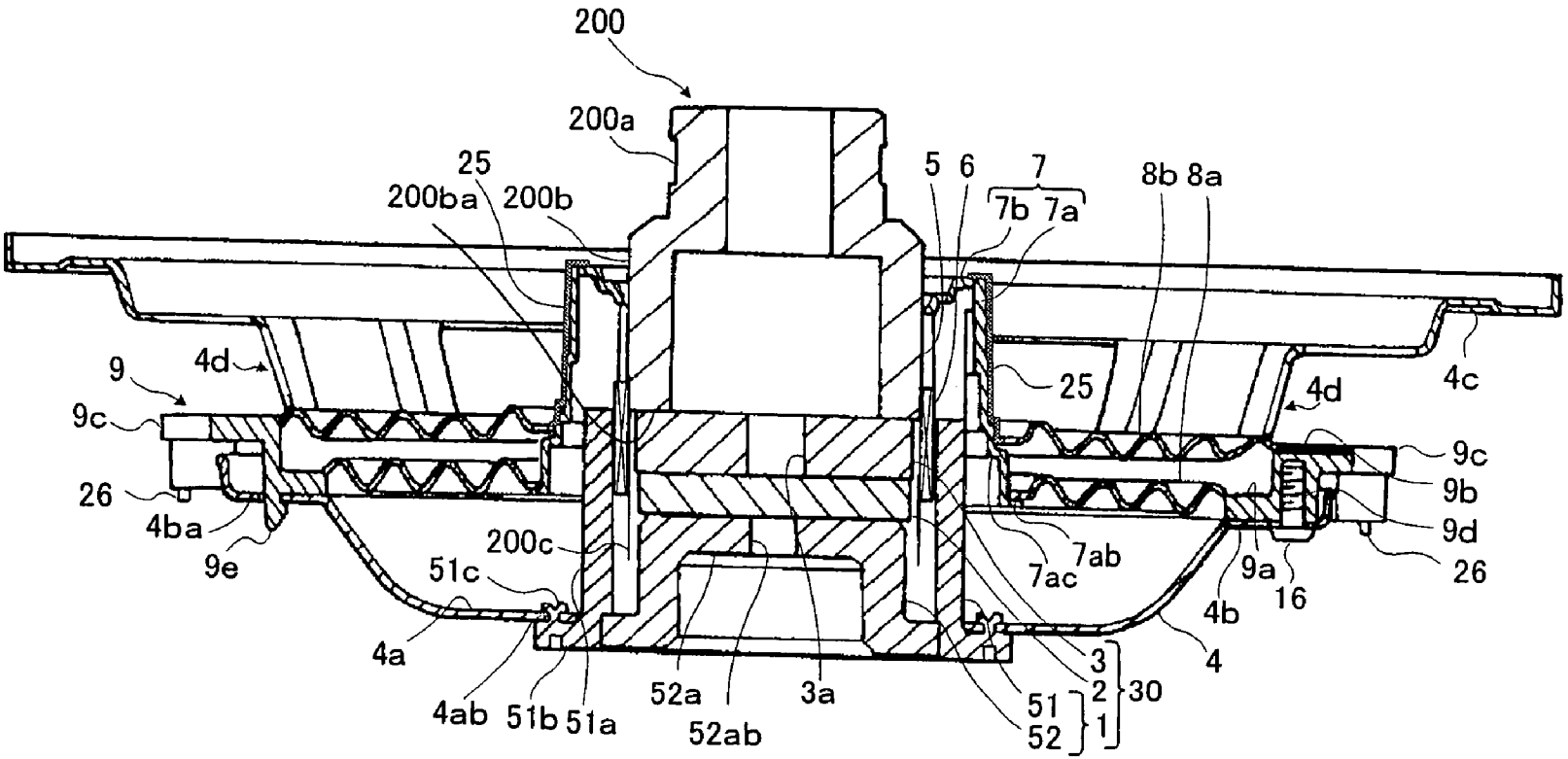
FIG. 17 is a cross-sectional view showing manufacturing steps of the speaker device according to the embodiment.

Next, the voice coil bobbin 5 and the connecting member 7 mounted on the voice coil gauge 200, i.e., the second integrated object, are arranged at the appropriate position of the vibration system 31 and the magnetic circuit 30 (step S4). Specifically, the second integrated object is arranged in the vibration system 31 and the magnetic circuit 20 so that the lower end surface 200*ba* of the second cylindrical part 200*b* of the voice coil gauge 200 being the component of the second integrated object contacts the upper surface of the plate 2 and so that the vicinity of the lower end portion of the voice coil bobbin 5 is positioned in the magnetic gap 20. FIG. 17 shows such a state.

Next, the damper 8*a* and the conductive damper 8*b* are mounted at the appropriate positions of the frame 4 and the connecting member 7 (step S5). Concretely, the inner peripheral edge portion of the damper 8*a* is mounted on the first flange part 7*ab* provided in the vicinity of the lower end portion of the outer peripheral wall of the connecting member 7, and the outer peripheral edge portion of the damper 8*a* is mounted on the first flat part 9*a* being the component of the supporting member 9. Next, the inner peripheral edge portion of the conductive damper 8*b* is mounted on the second flange part 7*ac* provided in the vicinity of the lower end portion of the outer peripheral wall of the connecting member 7, and the outer peripheral edge portion of the conductive damper 8*b* is mounted on the second flat part 9*b* being the component of the supporting member 9. FIG. 17 shows the mounting state.

Next, the plural terminal members 25 are mounted on the appropriate positions of the connecting member 7, i.e., on each of the terminal mounting parts 70, (step S6). Since the method is described above (see FIG. 8 and FIGS. 9A and 9B), the explanation is omitted. Thereby, the voice coil bobbin 5 can be arranged at the appropriate position of the magnetic circuit 30 and the vibration system 31 by using the voice coil gauge 200. Therefore, it can be prevented that a positional shift of the voice coil bobbin 5 occurs, and it becomes possible to obtain the above-mentioned operation and effect according to the embodiment of the present invention. Subsequently, the plural terminal members 26 are mounted on the appropriate positions of the supporting member 9, i.e., on each of the terminal mounting parts 9*c*, (step S7). Since the method is described above (see FIG. 6), the explanation thereof is omitted.

Next, each wiring and each of the terminal members are connected, and the soldering process thereto is executed (step S8). Concretely, as understood with reference to FIG. 5, each of the plus and minus lead wires 6*a* of the voice coil 6 is wound around the correspondent hook part 25*ad* of each terminal member 25, and the soldering (not shown) process is executed in the vicinity of each of the hook parts 25*ad* and each of the slits 25*ae* (four parts exist in this embodiment). Thereby, each of the lead wires 6*a* is electrically connected to each of the correspondent terminal members 25. Then, the soldering process is executed between the connecting part 25*e* of each of the terminal members 25 and the conductive part 8*be* of the conductive damper 8*b* (four parts exist in this embodiment). In addition, the soldering process is executed in the vicinity of the opening 26*ab* provided on the top board part 26*a* of each of the terminal members 26 (four parts exist in this embodiment). Further, each of the plus and minus output wirings 80 of the amplifier is wound around the connecting part 26*bb* of each of the correspondent terminal members 26, the soldering process is executed thereto (four parts exist in this embodiment). Namely, in this embodiment, as described above, the soldering process is executed to totally 12 parts. Thereby, each of the lead wires 6*a* of the voice coil 6 is electrically connected to each of the wirings 80 of the amplifier via each of the terminal members 25, each of the conductive parts 8*be* of the conductive damper 8*b* and each of the terminal members 26.

Figure 18:
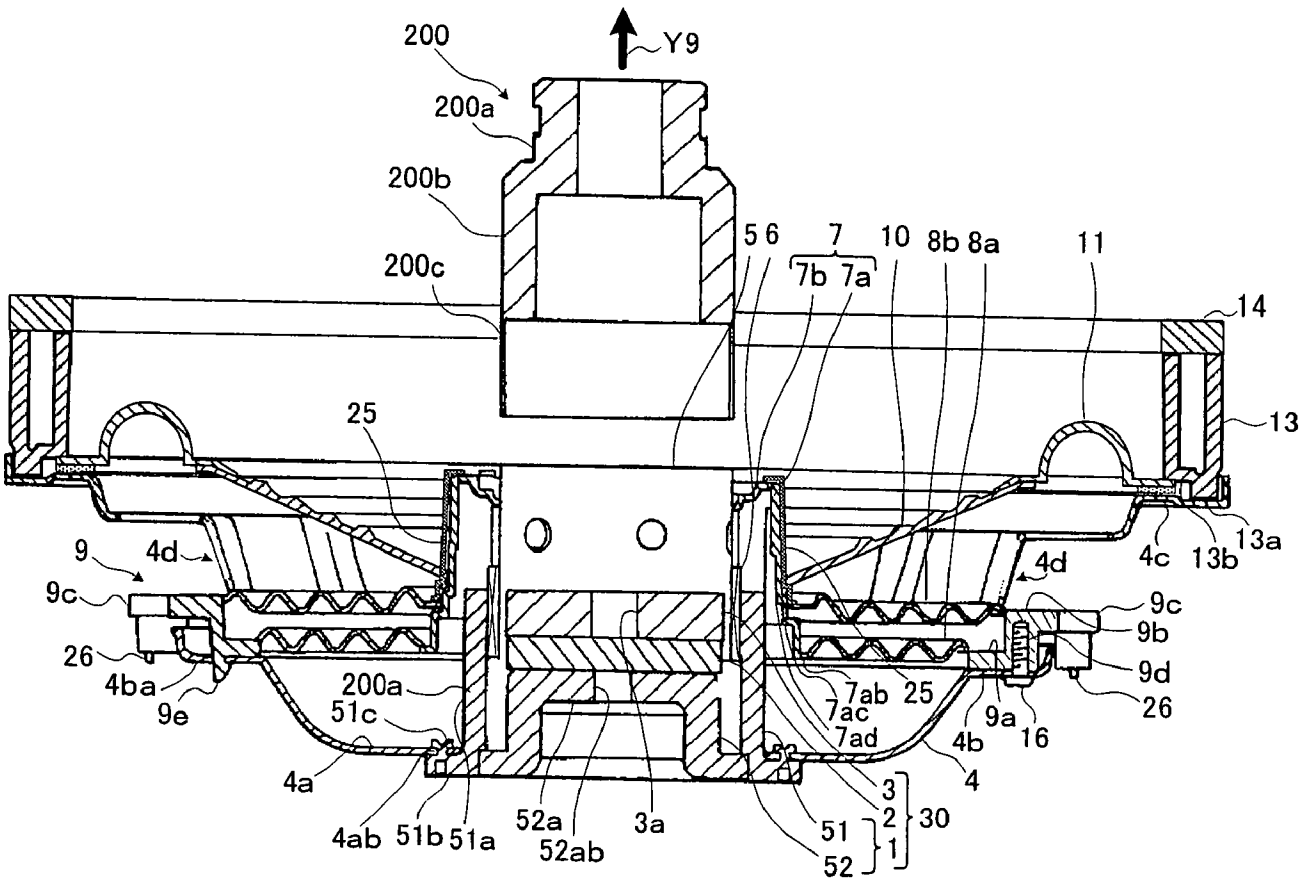
FIG. 18 is a cross-sectional view showing manufacturing steps of the speaker device according to the embodiment.

Next, the diaphragm 10, the edge 11, the packing 13 and the buffer member 14 are mounted (step S9). Specifically, as shown in FIG. 18, the inner peripheral edge portion of the diaphragm 10 is mounted on the third flange part 7*ad* of the connecting member 7, and the inner peripheral edge portion of the edge 11 is mounted on the outer peripheral edge portion of the diaphragm 10. Further, the outer peripheral edge portion of the edge 11 is mounted on the third flange part 4*c* of the frame 4. Next, the packing 13 is mounted on the edge 11 and the frame 4 so that the first flat surface 13*a* of the packing 13 contacts the third flange part 4*c* of the frame 4 and so that the second flat surface 13*b* of the packing 13 contacts the upper surface of the outer peripheral edge portion of the edge 11. Thereby, the outer peripheral edge portion of the edge 11, which is sandwiched by the second flat surface 13*b* of the packing 13 and the third flange part 4*c* of the frame 4, is fixed onto the third flange part 4*c*. Next, the buffer member 14 formed into a stick shape is deformed into an annular shape to be mounted on the packing 13.

Next, the adhesive 203 applied between the mounting base 7*bb* of the connecting member 7 and the outer peripheral wall of the voice coil bobbin 5 in the above-mentioned step S5 is dried. Then, the voice coil gauge 200 is moved in the direction of the arrow Y9 to be removed from the voice coil bobbin 5 (step S10). Subsequently, the cap 12 is mounted on the diaphragm 10 to cover the vicinity of the upper end portion of the voice coil bobbin 5 (step S11).

In this manner, the speaker device 100 according to this embodiment of the present invention, shown in FIGS. 1A and 1B and FIG. 2, is manufactured.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-163087 filed on Jun. 2, 2005 including the specification, claims, drawings and summary is incorporated herein by reference in its entirety.

What is claimed is:

1. A speaker device comprising:

a terminal member which is electrically connected to a voice coil; and a connecting member which is mounted on a voice coil bobbin, wherein an upwardly projecting first projecting part is formed at an upper end portion of the connecting member, and a mounting base having a groove is formed at a lower end portion of the connecting member, wherein an opening configured for receiving the first projecting part is formed at an upper end portion of the terminal member, and a mounting part mounted on the mounting base in a state of being inserted into the groove is formed at a lower end portion of the terminal member, wherein the terminal member includes a second projecting part configured for applying a force to the upper end portion of the terminal member in a circumferential direction of the connecting member using the mounting base as a fulcrum in a state that the mounting part is inserted into the groove, wherein the first projecting part includes a claw part comprising a substantially triangular cross-sectional shape and a hook-shaped projecting part provided at a position adjacent to the claw part, and wherein the claw part and the hook-shaped projecting part in a state of being inserted into the opening fix the upper end portion of the terminal member to the upper end portion of the connecting member.

2. The speaker device according to claim 1, wherein the second projecting part is provided on one end side of the upper end portion of the terminal member.

3. The speaker device according to claim 1, wherein an upwardly projecting third projecting part arranged at a position overlapping none of the first projecting part is formed at the upper end portion of the connecting member, and wherein, when an upper end surface of the connecting member is prescribed as a reference surface, a distance from the reference surface to an upper end surface of the third projecting part is relatively larger than a distance from the reference surface to an upper end surface of the first projecting part.

4. The speaker device according to claim 3, wherein the upper end surface of the third projecting part is upwardly positioned with respect to the upper end surface of the first projecting part.

5. The speaker device according to claim 3, wherein the distance from the reference surface to the upper end surface of the third projecting part is set to substantially 1.3 mm, and the distance from the reference surface to the upper end surface of the first projecting part is set to substantially 1.1 mm.

6. A speaker device comprising:

a terminal member which is electrically connected to a voice coil; and a connecting member which is mounted on a voice coil bobbin, wherein an upwardly projecting first projecting part is formed at an upper end portion of the connecting member, and a mounting base having a groove is formed at a lower end portion of the connecting member, wherein an opening configured for receiving the first projecting part is formed at an upper end portion of the terminal member, and a mounting part mounted on the mounting base in a state of being inserted into the groove is formed at a lower end portion of the terminal member, wherein the terminal member includes a second projecting part configured for applying a force to the upper end portion of the terminal member in a circumferential direction of the connecting member using the mounting base as a fulcrum in a state that the mounting part is inserted into the groove, wherein an upwardly projecting third projecting part arranged at a position overlapping none of the first projecting part is formed at the upper end portion of the connecting member, and wherein, when an upper end surface of the connecting member is prescribed as a reference surface, a distance from the reference surface to an upper end surface of the third projecting part is relatively larger than a distance from the reference surface to an upper end surface of the first projecting part.

7. The speaker device according to claim 6, wherein the upper end surface of the third projecting part is upwardly positioned with respect to the upper end surface of the first projecting part.

8. The speaker device according to claim 6, wherein the distance from the reference surface to the upper end surface of the third projecting part is set to substantially 1.3 mm, and the distance from the reference surface to the upper end surface of the first projecting part is set to substantially 1.1 mm.

* * * * *